US010354586B2

(12) United States Patent
Maeyama

(10) Patent No.: US 10,354,586 B2
(45) Date of Patent: Jul. 16, 2019

(54) IMAGE SIGNAL PROCESSING CIRCUIT, IMAGE SIGNAL PROCESSING METHOD, AND DISPLAY UNIT WITH PIXEL DEGRADATION CORRECTION

(71) Applicant: JOLED INC., Tokyo (JP)

(72) Inventor: Koichi Maeyama, Tokyo (JP)

(73) Assignee: JOLED INC., Tokyo (JP)

( * ) Notice: Subject to any disclaimer, the term of this patent is extended or adjusted under 35 U.S.C. 154(b) by 587 days.

(21) Appl. No.: 14/891,619

(22) PCT Filed: Apr. 11, 2014

(86) PCT No.: PCT/JP2014/060532

§ 371 (c)(1),
(2) Date: Nov. 16, 2015

(87) PCT Pub. No.: WO2014/188813

PCT Pub. Date: Nov. 27, 2014

(65) Prior Publication Data

US 2016/0086548 A1 Mar. 24, 2016

(30) Foreign Application Priority Data

May 23, 2013 (JP) ..... 2013-108466

(51) Int. Cl.
*G09G 3/3258* (2016.01)

(52) U.S. Cl.
CPC ... *G09G 3/3258* (2013.01); *G09G 2300/0413* (2013.01); *G09G 2320/0233* (2013.01);
(Continued)

(58) Field of Classification Search
None
See application file for complete search history.

(56) References Cited

U.S. PATENT DOCUMENTS

2003/0122813 A1* 7/2003 Ishizuki ..... G09G 3/3233 345/211
2005/0052350 A1* 3/2005 Mizukoshi ..... G09G 3/3233 345/55

(Continued)

FOREIGN PATENT DOCUMENTS

JP 2003202837 7/2003
JP 2007187761 7/2007

(Continued)

OTHER PUBLICATIONS

International Search Report for Application PCT/JP2014/060532 dated Jun. 14, 2015 (2 pgs).

*Primary Examiner* — David D Davis
(74) *Attorney, Agent, or Firm* — Michael Best & Friedrich LLP

(57) ABSTRACT

An image signal processing circuit is provided that includes a display panel, a current detection section, a modification processing section, and a correction processing section. The display panel includes a first dummy pixel that is provided outside of an effective pixel region. The current detection section detects a change in a current in the first dummy pixel. The modification processing section modifies a predetermined predicted degradation value based on an actual degradation amount of the detected current. The correction processing section corrects an image signal based on the predetermined predicted degradation value after modification. The image signal is used to drive an effective pixel.

8 Claims, 16 Drawing Sheets

(52) U.S. Cl.
CPC . *G09G 2320/043* (2013.01); *G09G 2330/026* (2013.01); *G09G 2330/12* (2013.01)

(56) References Cited

U.S. PATENT DOCUMENTS

| | | | | |
|---|---|---|---|---|
| 2007/0095639 | A1* | 5/2007 | Kim | G09G 3/3216 200/310 |
| 2010/0238149 | A1* | 9/2010 | Kishi | G09G 3/3233 345/206 |
| 2010/0265228 | A1* | 10/2010 | Kimura | G09G 3/3233 345/207 |
| 2011/0242143 | A1* | 10/2011 | Yamashita | G09G 3/3233 345/690 |
| 2011/0248975 | A1* | 10/2011 | Takuma | G09G 3/3225 345/207 |
| 2012/0162284 | A1* | 6/2012 | Yamashita | G09G 3/3233 345/690 |
| 2015/0106844 | A1* | 4/2015 | Funatsu | H04N 21/4122 725/34 |
| 2015/0154910 | A1* | 6/2015 | Okuno | G09G 3/3258 345/212 |

FOREIGN PATENT DOCUMENTS

| | | |
|---|---|---|
| JP | 2010002796 | 1/2010 |
| JP | 2011065048 | 3/2011 |
| JP | 2011076025 | 4/2011 |
| JP | 2012141332 | 7/2012 |
| JP | 2012141456 | 7/2012 |
| JP | 2012073489 | 9/2012 |
| WO | 1998040871 | 9/1998 |
| WO | 2011095954 | 8/2011 |

* cited by examiner

[ FIG. 1 ]
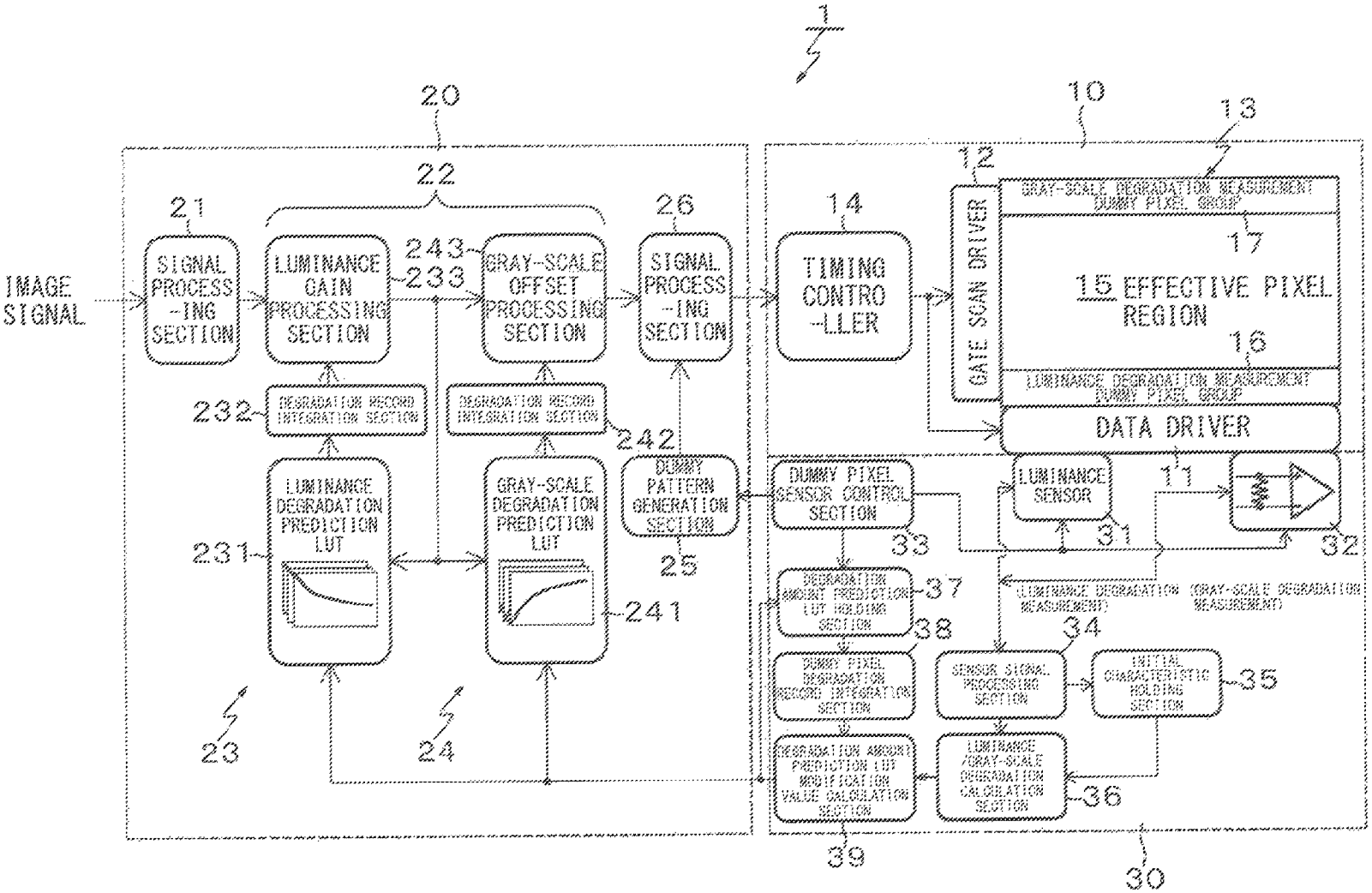

[ FIG. 2 ]
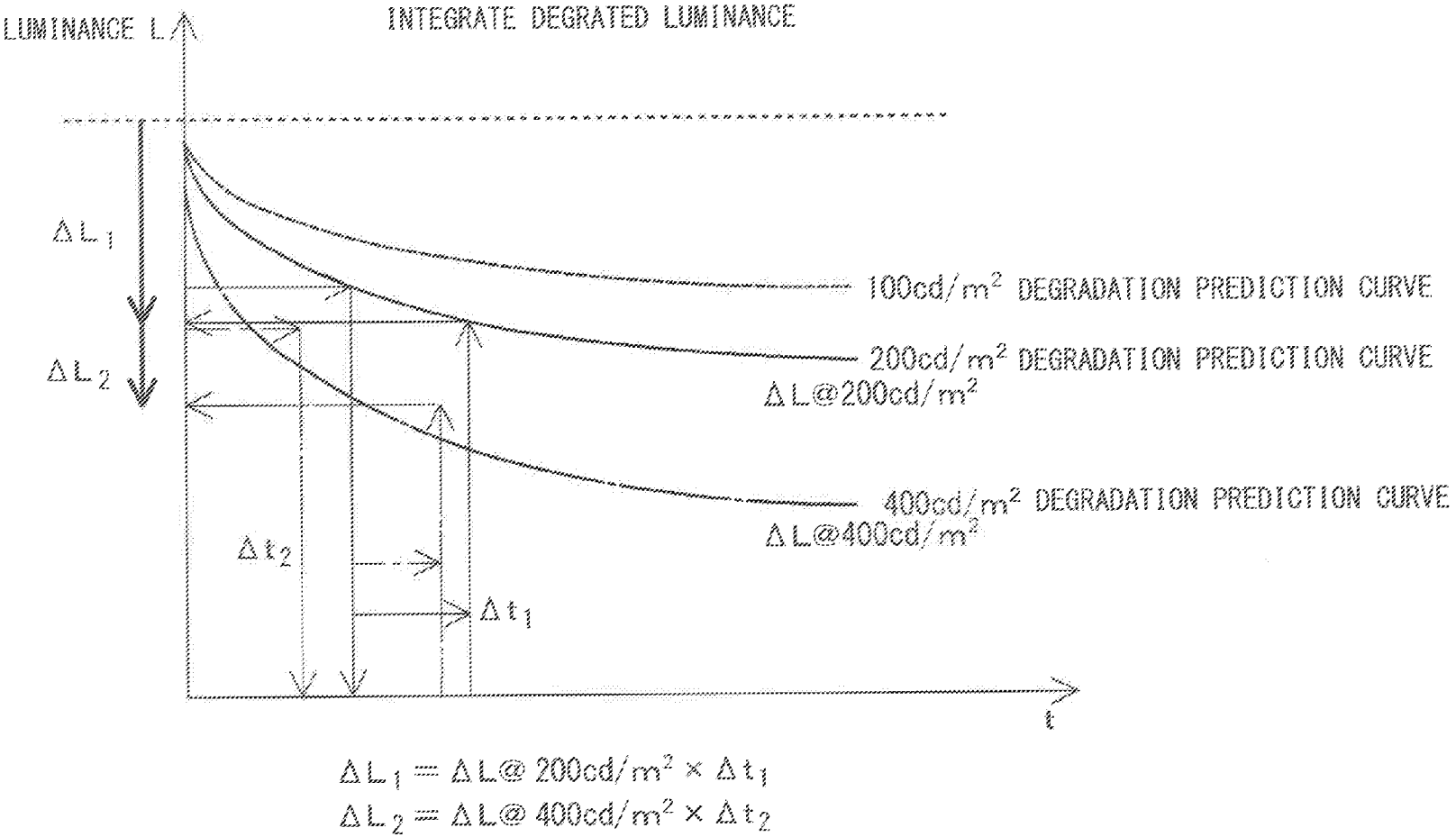

[ FIG. 3A ]
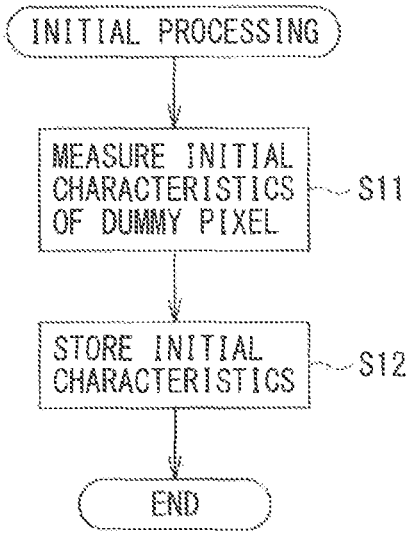
[ FIG. 3B ]
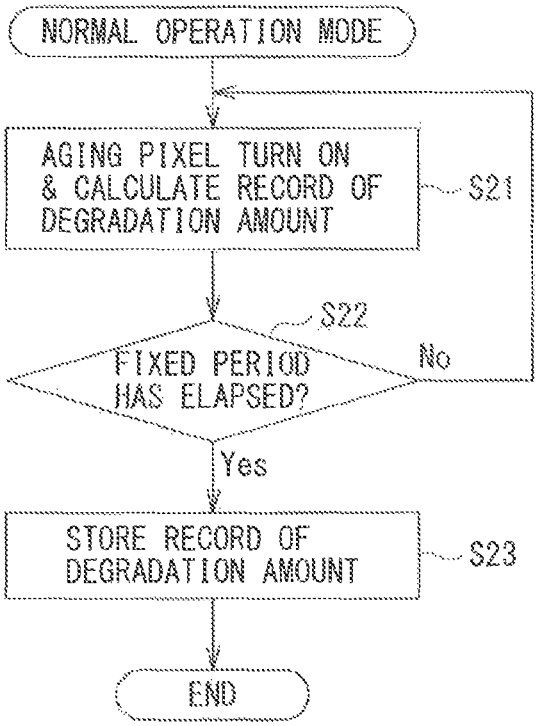

[ FIG. 4 ]
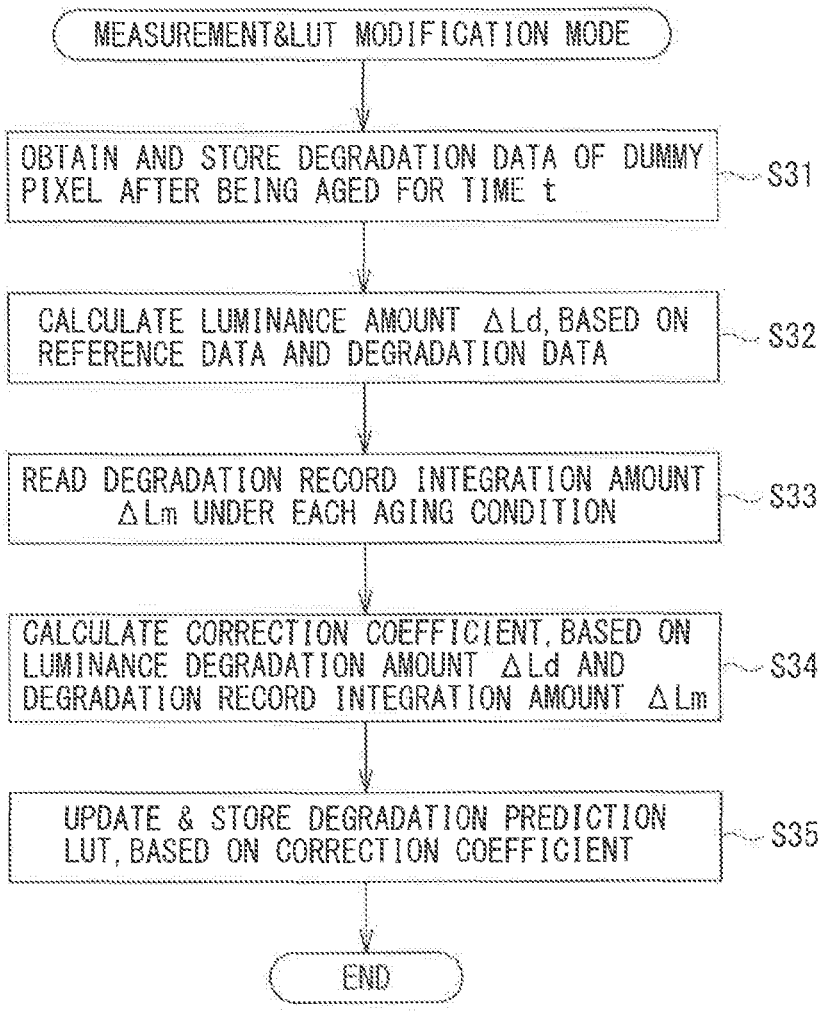

[ FIG. 5A ]
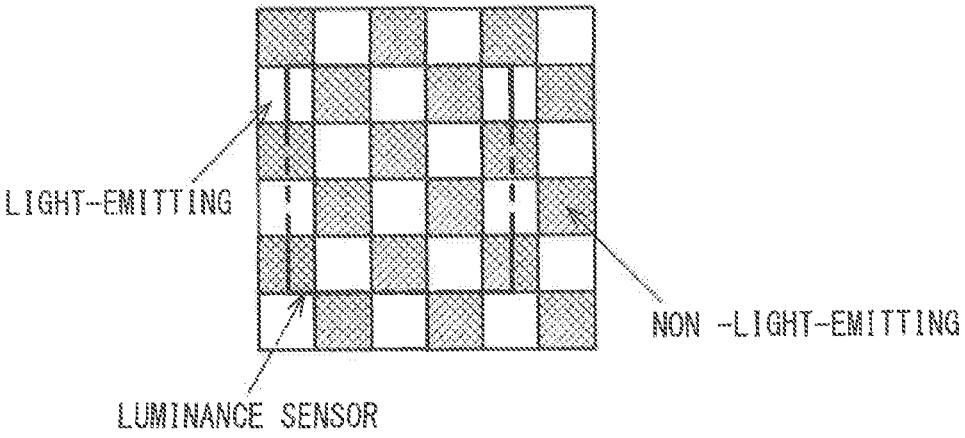
[ FIG. 5B ]
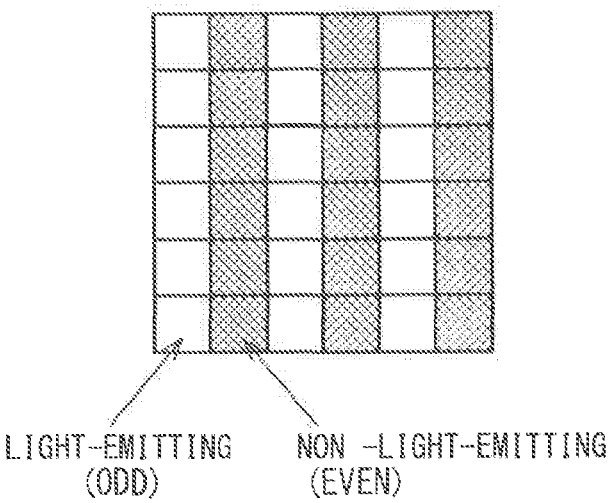

[ FIG. 6 ]
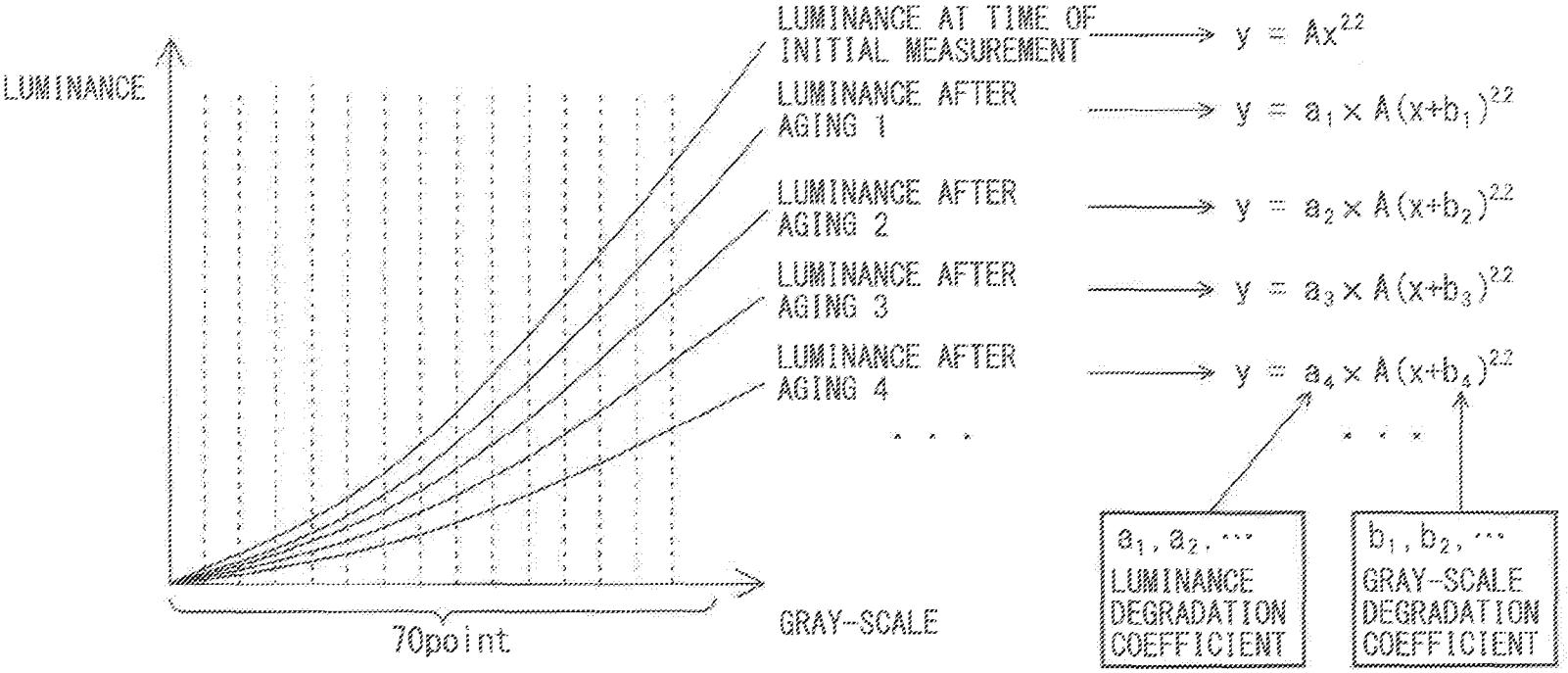

[ FIG. 7A ]
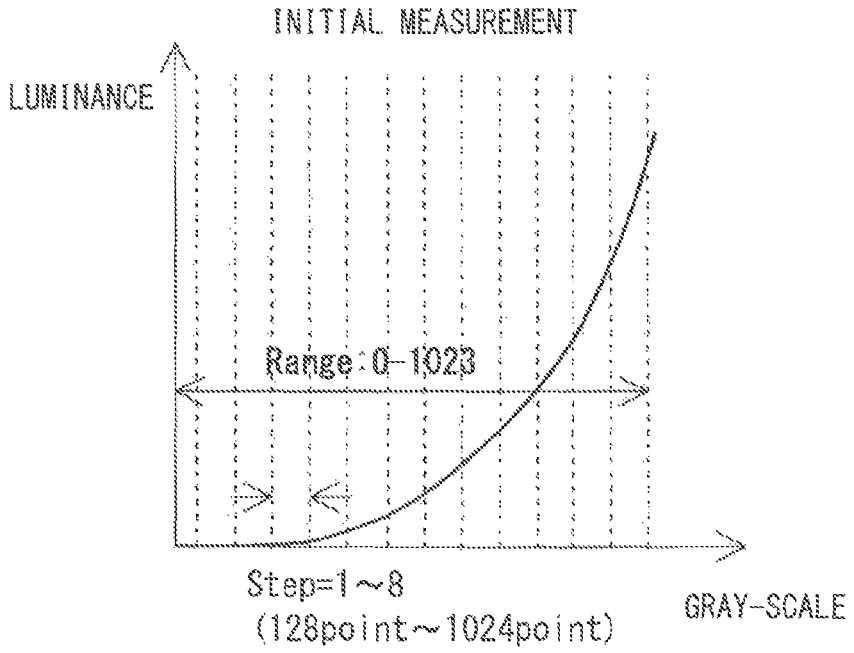
[ FIG. 7B ]
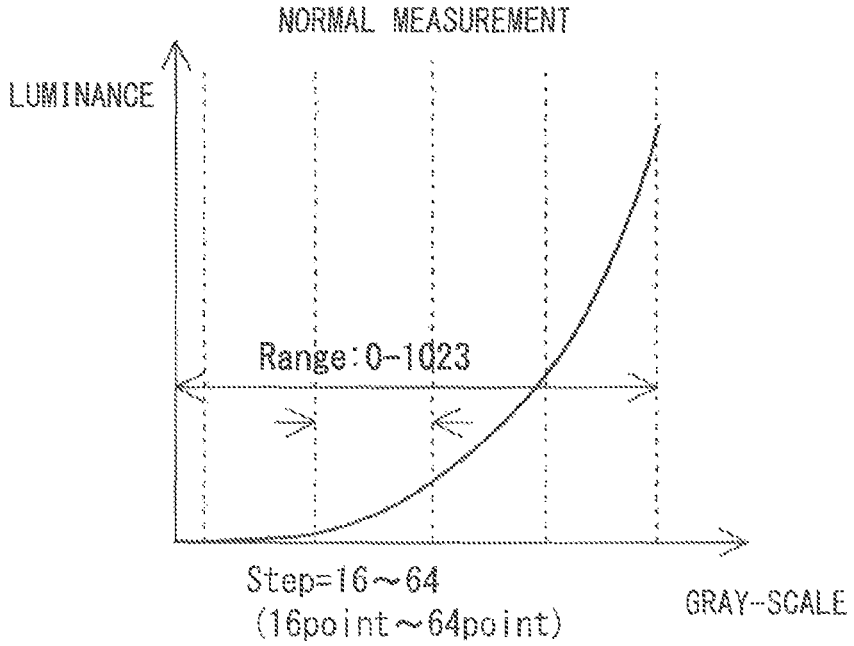

[ FIG. 8A ]
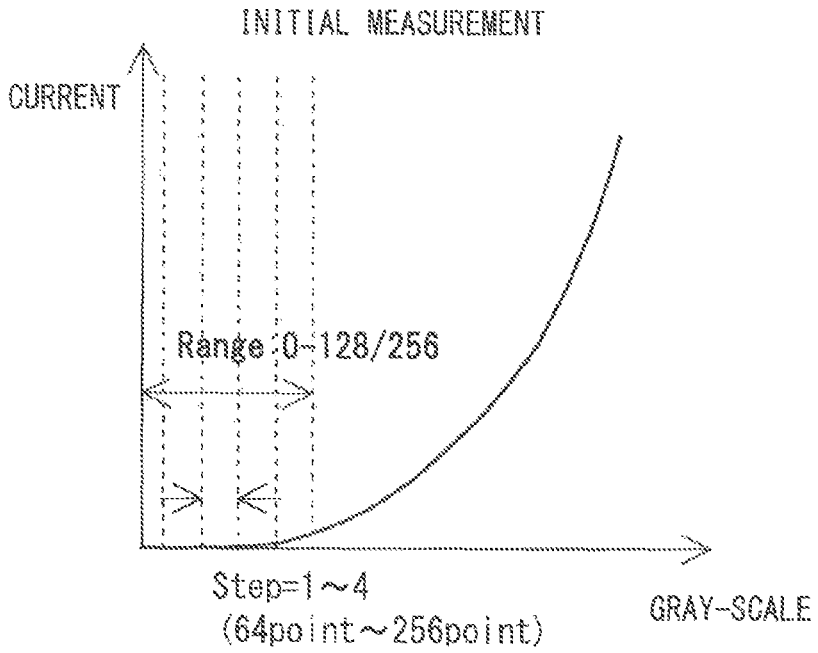
[ FIG. 8B ]
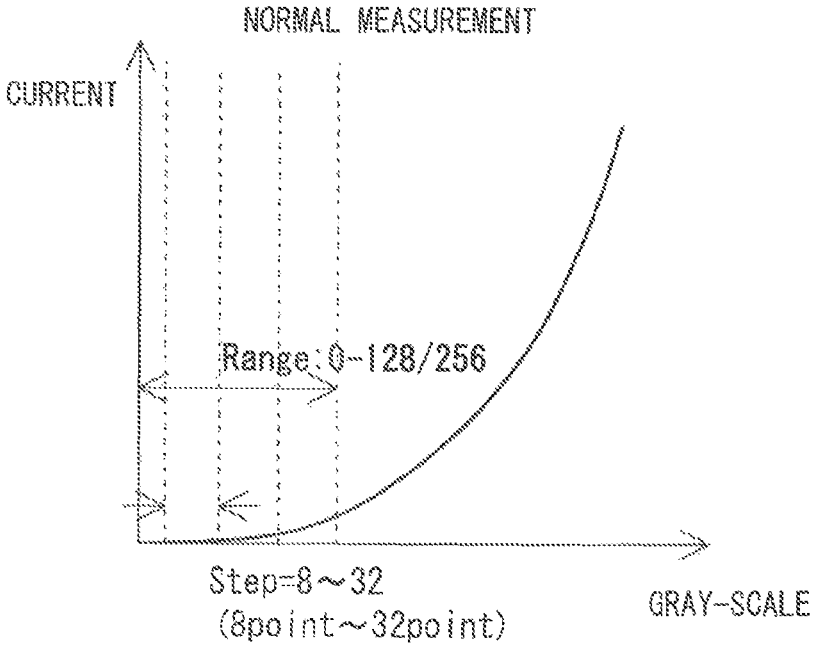

[ FIG. 9 ]
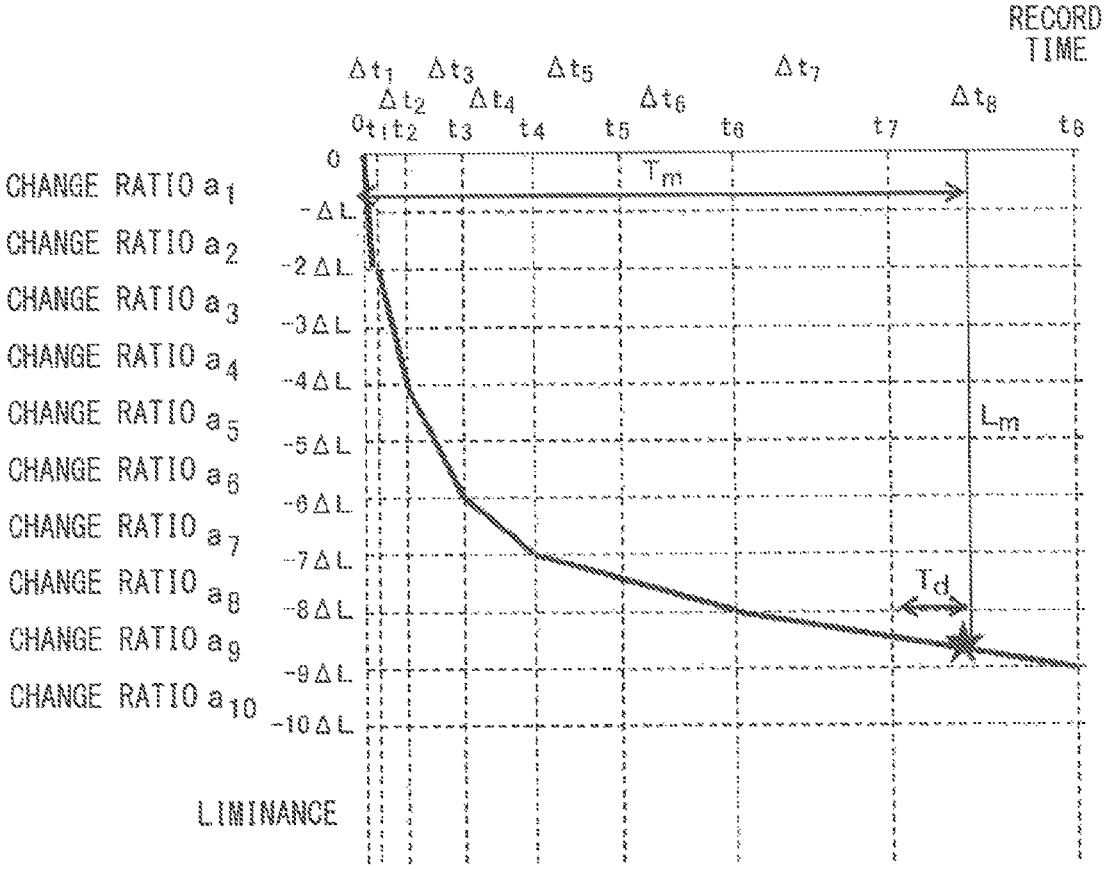

[ FIG. 10 ]
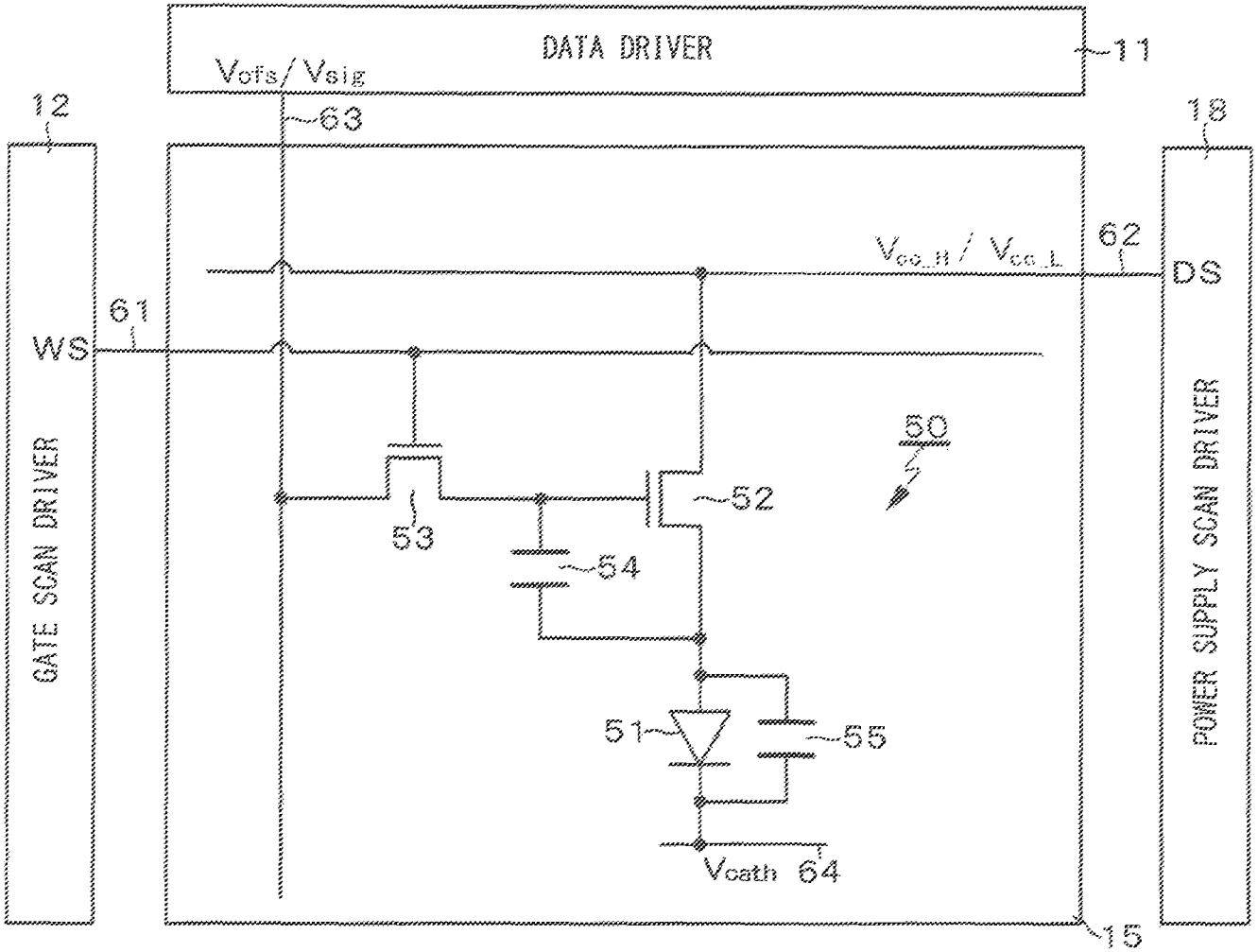

[ FIG. 11 ]
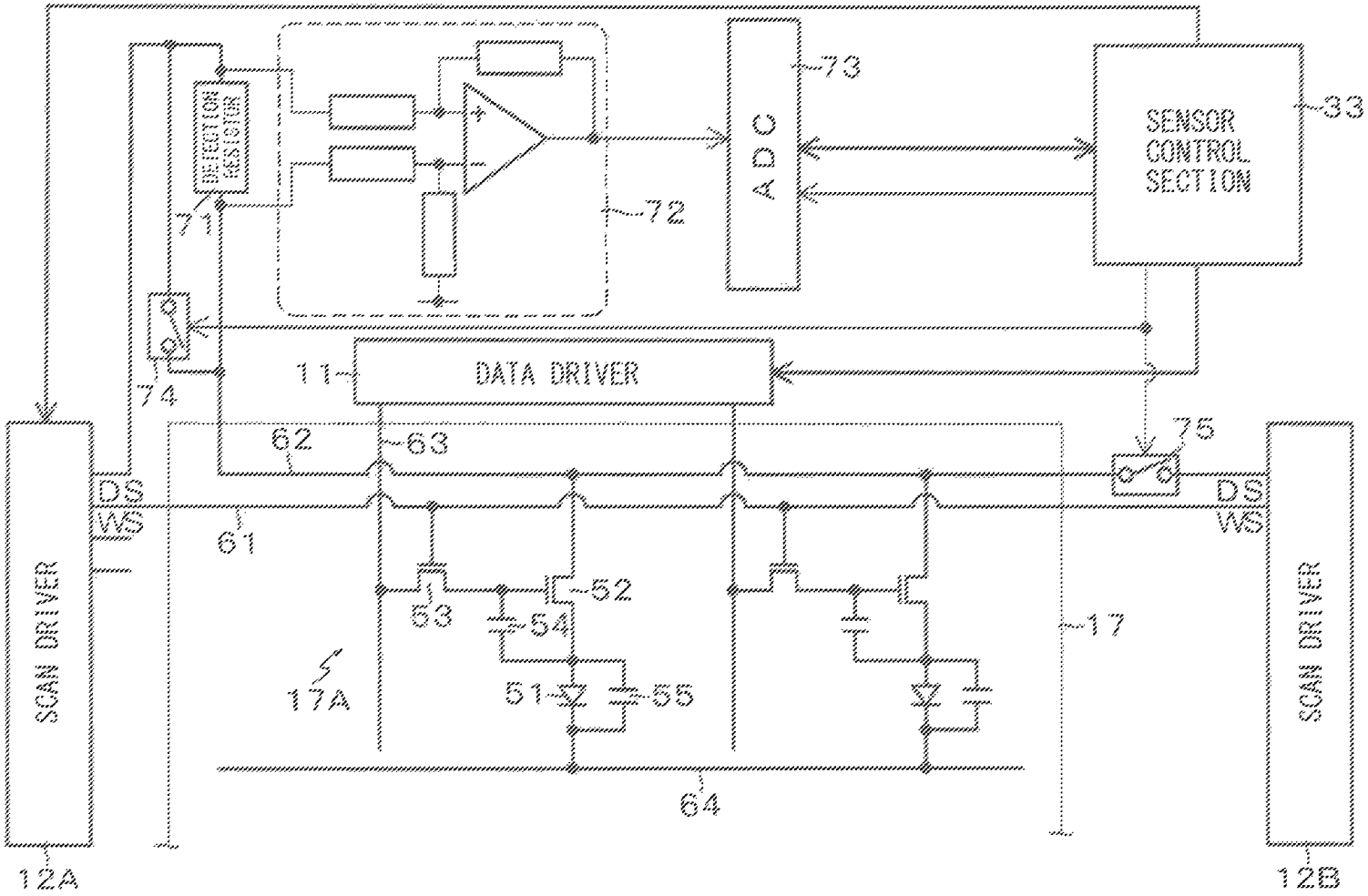

[ FIG. 12 ]
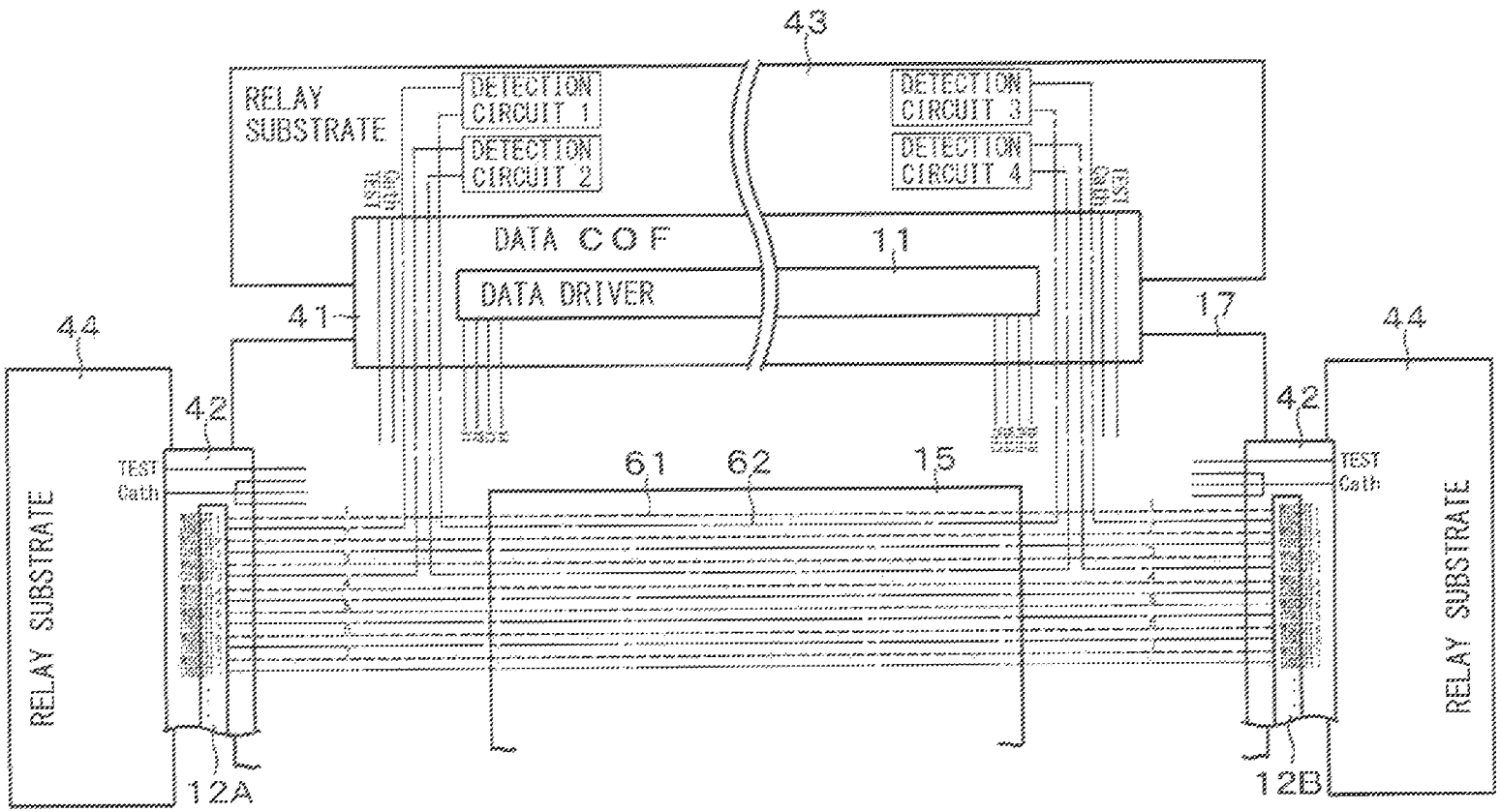

[ FIG. 13 ]

| CURRENT DUMMY PIXEL MODE | SWITCH 74 ON DETECTION RESISTOR SIDE | SWITCH 75 ON SEPARATION GATE SIDE |
|---|---|---|
| AGING MODE · START-UP | Close | Close |
| UNUSED (ONE-SIDE DRIVING AGING) | Close | Open |
| UNUSED ($I_{ds}$/2 MEASUREMENT) | Open | Close |
| CURRENT MEASUREMENT MODE | Open | Open |

[ FIG. 14 ]
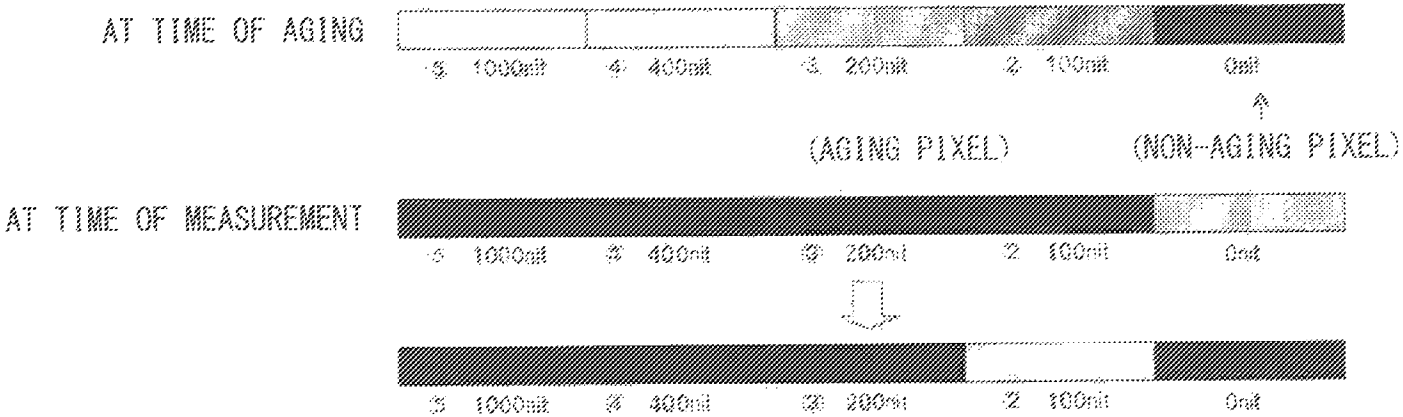

[ FIG. 15 ]
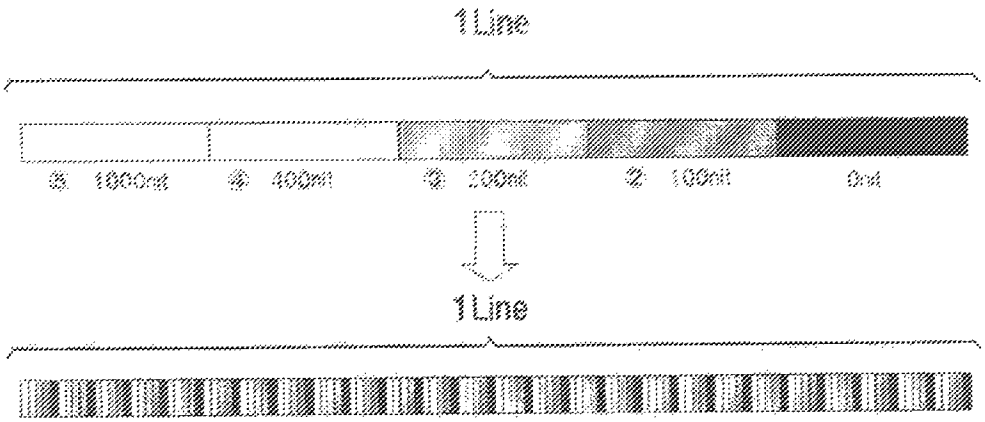

[ FIG. 16 ]
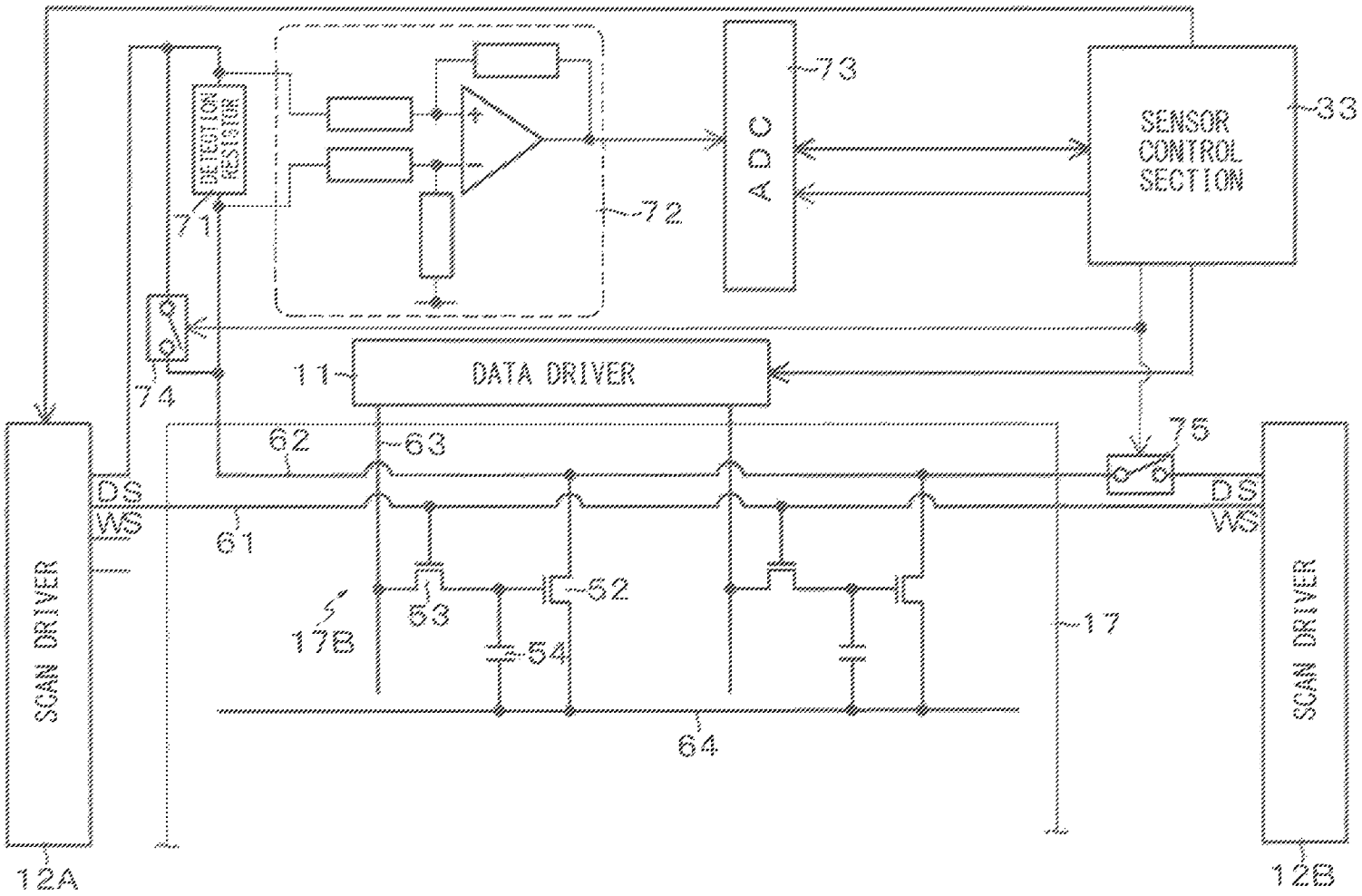

IMAGE SIGNAL PROCESSING CIRCUIT, IMAGE SIGNAL PROCESSING METHOD, AND DISPLAY UNIT WITH PIXEL DEGRADATION CORRECTION

TECHNICAL FIELD

The disclosure relates to an image signal processing circuit, an image signal processing method, and a display unit.

BACKGROUND ART

In a display unit, more specifically, a flat panel (planar) display unit, luminance degradation with time of a display panel is corrected, based on a degradation value (a predicted degradation value) predicted from information of a pixel signal and typical degradation characteristics of the display panel. However, since the degradation characteristics vary for each display panel, it is not possible to sufficiently correct the degradation, based on a typical predicted degradation value (an estimated value) only.

As a countermeasure, there has been proposed technology in which an actual luminance degradation state of each display panel is measured with use of a dummy pixel by a luminance sensor, and a predicted degradation value (an estimated value) is adjusted at regular intervals, based on a thus-obtained measurement result so as to correspond to the actual degradation state, thereby insuring correction accuracy (for example, refer to Patent Literature 1).

CITATION LIST

Patent Literature

Patent Literature 1: Japanese Unexamined Patent Application Publication No. 2007-187761

SUMMARY OF INVENTION

However, as with the above-described related art, in measurement of the actual degradation state by the luminance sensor, it is difficult to accurately detect a change in luminance greatly influencing image quality degradation on a low-luminance side, i.e., a voltage shift at light emission state point (a light emission start voltage shift/offset).

Nevertheless, it is not impossible to accurately detect the light emission start voltage shift (gray-scale degradation) with use of the luminance sensor. However, since, in addition to the necessity of using a large-area luminance sensor with high light reception sensitivity, a luminance sensor having performance substantially equal to that of an expensive measuring instrument is necessary because of the necessity of long-time measurement and the like; therefore, cost and the number of man-hours for adjustment are increased, and an influence of restrictions or the like on convenience in use by a user is increased.

This disclosure aims to provide an image signal processing circuit that is allowed to accurately correct variation in a predicted degradation value (an estimated value) of a light emission start voltage shift greatly influencing image quality degradation on a low-luminance side without using an expensive luminance sensor or the like, an image signal processing method, and a display unit including the image signal processing circuit.

Solution to Problem

An image signal processing circuit according to the present disclosure includes: a display panel including a first dummy pixel provided outside an effective pixel region; a current detection section configured to detect a change in a current in the first dummy pixel; a modification processing section configured to modify a predetermined predicted degradation value, based on an actual degradation amount of the current detected by the current detection section; and a correction processing section configured to correct an image signal, based on the predicted degradation value modified by the modification processing section, the image signal being adapted to drive an effective pixel.

Moreover, an image signal processing method according to the present disclosure includes: detecting a change in a current of a first dummy pixel provided outside an effective pixel region of a display panel; modifying a predetermined predicted degradation value, based on an actual degradation amount of the detected current; and correcting an image signal, based on the modified predicted degradation value, the image signal being adapted to drive an effective pixel.

Further, a display unit according to the present disclosure is provided with an image signal processing circuit, the image signal processing circuit including: a display panel including a first dummy pixel provided outside an effective pixel region; a current detection section configured to detect a change in a current in the first dummy pixel; a modification processing section configured to modify a predetermined predicted degradation value, based on an actual degradation amount of the current detected by the current detection section; and a correction processing section configured to correct an image signal, based on the predicted degradation value modified by the modification processing section, the image signal being adapted to drive an effective pixel.

Factors of luminance degradation with time of the display panel includes, in addition to a decline in light emission efficiency of a light emission section of the effective pixel, degradation (a decline) in characteristics of a transistor that drives the light emission section. Degradation in the characteristics of the transistor that drives the light emission section is allowed to be detected by providing a dummy pixel outside the effective pixel region of the display panel and detecting an actual degradation amount of a current of the dummy pixel. Then, when the predetermined predicted degradation value for correction on an image signal that drives the effective pixel is modified, based on the actual degradation amount of the current of the dummy pixel, and correction processing is performed with use of the modified predicted degradation value, luminance degradation including the degradation in the transistor characteristics is allowed to be corrected.

Advantageous Effects of Invention

According to the disclosure, even if an expensive luminance sensor or the like is not used, it is possible to accurately correct variation in the predicted degradation value (estimated value) of the light emission start voltage shift greatly influencing image quality degradation on the low-luminance side; therefore, correction accuracy for the luminance degradation with time of the display panel is allowed to be improved.

It is to be noted that the effects described in this description are merely examples; therefore, effects are not limited thereto, and may also include additional effect.

BRIEF DESCRIPTION OF DRAWINGS

FIG. 1 is a block diagram illustrating a system configuration of a display unit according to an embodiment of the disclosure.

FIG. 2 is a diagram describing a concept of burn-in correction executed in a correction processing section.

FIG. 3A is a flowchart illustrating a procedure of steps of initial processing and FIG. 3B is a flowchart illustrating a procedure of a normal operation mode of normal processing.

FIG. 4 is a flowchart illustrating a procedure of a measurement/LUT modification mode of the normal processing.

FIG. 5A is a pattern diagram of a detection pattern with a checkered pattern configuration, and FIG. 5B is a pattern diagram of a detection pattern with a vertical-striped pattern configuration.

FIG. 6 is a diagram describing a degradation amount calculation method.

FIG. 7A is a diagram illustrating V-L characteristics at the time of initial measurement in luminance degradation measurement, and FIG. 7B is a diagram illustrating V-L characteristics at the time of normal measurement in the luminance degradation measurement.

FIG. 8A is a diagram illustrating V-L characteristics at the time of initial measurement in gray-scale degradation measurement, and FIG. 8B is a diagram illustrating V-L characteristics at the time of normal measurement in the gray-scale degradation measurement.

FIG. 9 is a diagram illustrating luminance degradation curve characteristics.

FIG. 10 is a circuit diagram illustrating an example of a specific circuit configuration of an effective pixel.

FIG. 11 is a circuit diagram illustrating an example of a configuration of a current sensor (a current detection circuit).

FIG. 12 is a wiring diagram illustrating an example of wiring lead-out of a power supply line for current detection of a dummy pixel for gray-scale degradation measurement.

FIG. 13 is a diagram illustrating an operation example of two switches of a current sensor.

FIG. 14 is a diagram illustrating an example of a detection pattern for current change detection applied to a dummy pixel for gray-scale degradation measurement.

FIG. 15 is a diagram illustrating another example of the detection pattern for current change detection applied to the dummy pixel for gray-scale degradation measurement.

FIG. 16 is a circuit diagram illustrating a circuit configuration of a dummy pixel according to a modification example.

MODE FOR CARRYING OUT THE INVENTION

Modes for carrying out technology of the disclosure (hereinafter referred to as "embodiments") will be described in detail below referring to the accompanying drawings. The disclosure is not limited to the embodiments, and various numerical values and the like in the embodiments are merely examples. In the following description, same components or components with same function are denoted by same reference numerals, and description of the components will not be repeated. It is to be noted that description will be given in the following order.

1. General Description of Image Signal Processing Circuit, Image Signal Processing Method, and Display Unit of Disclosure
2. Description of Embodiments
3. Modification Examples (General Description of Image Signal Processing Circuit, Image Signal Processing Method, and Display Unit of Disclosure)

An image signal processing circuit or an image signal processing method of the disclosure is suitably used in a display unit in which a light emission section of an effective pixel contributing to image display is configured of a current-driven light-emitting device of which light emission is controlled according to intensity (magnitude) of a current. As the current-driven light-emitting device, for example, an organic electroluminescence device (hereinafter referred to as "organic EL device") using a phenomenon in which light is emitted in response to application of an electric field to an organic thin film may be used. Examples of the current-driven light-emitting device may include not only the organic EL device but also an inorganic EL device, an LED device, and a laser diode device.

The organic EL display unit using the organic EL device as the light emission section of the pixel has the following characteristics. Since the organic EL device is allowed to be driven at an applied voltage of 10 V or less, the organic EL display unit features low power consumption. Since the organic EL device is a self-luminous device, the organic EL display unit has higher visibility of an image, compared to a liquid crystal display unit that is also a flat display unit. Moreover, an illumination member such as a backlight is not necessary in the organic EL display unit; therefore, the weight and thickness of the organic EL display unit are easily reduced. Further, the response speed of the organic EL device is extremely high, i.e., about several μsec; therefore, in the organic EL display unit, an afterimage does not occur at the time of displaying of a moving image.

In the image signal processing circuit, the image signal processing method, and the display unit of the disclosure, a current that is to be detected by a current detection section may be a current passing through a transistor that drives a light emission section of a first dummy pixel. Thus, degradation (decline) in characteristics of the transistor that drives the light emission section as one factor of luminance degradation with time of the display panel is allowed to be detected.

The image processing circuit, the image signal processing method, and the display unit that have the above-described preferable configuration of the disclosure may be configured to provide a second dummy pixel outside an effective pixel region and include a luminance detection section that detects a change in a luminance in the second dummy pixel. Thus, a decline in light emission efficiency of a light emission section of an effective pixel as another factor of luminance degradation with time of the display panel is allowed to be detected. At this time, a modification processing section may be configured to modify a predetermined predicted degradation value, based on an actual degradation amount of the detected current and an actual degradation amount of the detected luminance.

Moreover, in the image processing circuit, the image signal processing method, and the display unit that have the above-described preferable configuration of the disclosure, the first dummy pixel and the second dummy pixel may have a configuration similar to that of the effective pixel, and may have the same operation condition as that of the effective pixel. Further, one or more rows of the first dummy pixels and one or more rows of the second dummy pixels may be configured to be provided outside the effective pixel region. Here, a common pixel may be shared by the first dummy pixel and the second dummy pixel. Alternatively, the first dummy pixel and the second dummy pixel may be configured to have a light-shielding configuration.

Furthermore, in the image processing circuit, the image signal processing method, and the display unit that have the above-described preferable configuration of the disclosure, the current detection section may be configured to include a detection resistor and a detection amplifier. Here, the detection resistor is connected between an output terminal of a driver that drives the first dummy pixel and a power supply line that supplies a power supply voltage to the first dummy pixel. The detection amplifier detects a voltage value generated between both terminals of the detection resistor.

Moreover, in the image processing circuit, the image signal processing method, and the display unit that have the above-described preferable configuration of the disclosure, in a case where the display panel has a configuration in which a power supply voltage is supplied from both sides horizontally, the current detection section may be configured to include a switch that blocks supply of the power supply voltage from one side of the display panel at the time of detection of the change in the current. Further, the current detection section may be configured to include a switch that selectively shorts both terminals of the detection resistor. Alternatively, in a case where a light emission current of the first dummy pixel serves as a pulsed response, the current detection section may be configured to detect the current change in synchronization with the light emission current as the pulsed response.

Further, in the image processing circuit, the image signal processing method, and the display unit that have the above-described preferable configuration of the disclosure, a detection pattern for detection of the change in the current may be so configured that one line is divided into a plurality of pixel blocks, and is configured of one or more kinds of always-lighting pixel blocks with different luminance conditions and a non-lighting pixel block. Alternatively, the detection pattern for detection of the change in the current may be configured of a combination of always-lighting pixels with one or more kinds of luminance conditions and a non-lighting pixel, and a plurality of blocks of the detection pattern may be periodically provided in one line.

Furthermore, in the image processing circuit, the image signal processing method, and the display unit that have the above-described preferable configuration of the disclosure, the first dummy pixel may be configured not to include a light emission section. In other words, while the effective pixel includes at least a light emission section and a transistor that drives the light emission section, the first dummy pixel does not include a light emission section. Therefore, a light-shielding configuration is not necessary in a region where the first dummy pixel is provided.

Description of Embodiments

FIG. 1 is a block diagram illustrating a system configuration of a display unit according to an embodiment of the disclosure.

In this embodiment, description will be given, as an example, of an active matrix organic EL display unit configured of a current-driven light-emitting device (an electro-optic device), for example, an organic EL device, in which light emission of a light emission section of an effective pixel contributing to image display is controlled according to intensity (magnitude) of a current.

The active matrix organic EL display unit is a display unit in which a current passing through the organic EL device is controlled by an active device, for example, an insulated gate field effect transistor provided in a same pixel provided with the organic EL device. As the insulated gate field effect transistor, a TFT (Thin Film Transistor) may be typically used. The organic EL display unit 1 according to this embodiment is configured of a display panel module (an organic EL panel module) 10, a correction processing section 20, and a modification processing section 30.

In the display panel module 10, the light-emitting device (the organic EL device in this example) configuring the display panel has a characteristic of being degraded in proportional to a light emission amount and light emission time thereof. On the other hand, an image displayed on the display panel is not uniform. Therefore, degradation of the light-emitting devices in a specific display region is more likely to progress. Then, luminance of the light-emitting devices in the specific display region of which degradation progresses is relatively decreased, compared to luminance of the light-emitting devices in the other display region. A phenomenon in which luminance degradation partially occurs in the display panel is typically called "burn-in".

In this embodiment, correction processing on luminance degradation causing burn-in of the display panel is performed by the correction processing section 20 and the modification processing section 30. The correction processing section 20 and the modification processing section 30 correspond to an image signal processing circuit of the disclosure. Moreover, a processing method by the correction processing section 20 and the modification processing section 30 corresponds to an image signal processing method of the disclosure. The correction processing section 20 performs various kinds of correction processing including correction processing on luminance degradation of the display panel (the organic EL panel), based on a predetermined predicted degradation value (an estimated value). The modification processing section 30 may be configured of, for example, a CPU (central processing unit), and performs processing of obtaining a desired measurement result by control of various sensors that will be described later or with use of various sensors, and modifying the predetermined predicted degradation value (the estimated value), based on the thus-obtained result.

[Configuration of Display Panel Module]

The display panel module 10 includes an organic EL panel 13 including a data driver 11 and a gate scan driver 12, and a timing controller 14 that drives the data driver 11, the gate scan driver 12, and the like.

The organic EL panel 13 includes, in addition to an effective pixel region 15 configured by two-dimensionally providing effective pixels contributing to image display in a matrix, a luminance degradation measurement dummy pixel group 16 and a gray-scale degradation measurement dummy pixel group 17 in proximity to the effective pixel region 15. Dummy pixels in the luminance degradation measurement dummy pixel group 16 are pixels (second dummy pixels) for monitoring of luminance degradation, and do not contribute to image display. The gray-scale degradation measurement dummy pixel group 17 includes pixels (first dummy pixels) for monitoring of gray-scale degradation, that do not contribute to image display. For example, the luminance degradation measurement dummy pixel group 16 may be disposed below the effective pixel region 15, and the gray-scale degradation measurement dummy pixel group 17 may be disposed above the effective pixel region 15. However, the positions of the luminance degradation measurement dummy pixel group 16 and gray-scale degradation measurement dummy pixel group 17 are not limited to this layout example.

Each of the dummy pixels in the luminance degradation measurement dummy pixel group 16 and the gray-scale degradation measurement dummy pixel group 17 has a similar configuration (that will be described in detail later) to that of the effective pixel in the effective pixel region 15, and one or more rows of the dummy pixels in the luminance degradation measurement dummy pixel group 16 and one or more rows of the dummy pixels in the gray-scale degradation measurement dummy pixel group 17 are provided in proximity to the effective pixel region 15. Moreover, each of the dummy pixels in the luminance degradation measurement dummy pixel group 16 and the gray-scale degradation measurement dummy pixel group 17 has the same operation conditions (driving conditions) such as a driving voltage and driving timing as those of the effective pixel in the effective pixel region 15. Each of the dummy pixels in the luminance degradation measurement dummy pixel group 16 and the gray-scale degradation measurement dummy pixel group 17 is driven by the gate scan driver 12 as with the effective pixel in the effective pixel region 15.

[Configuration of Correction Processing Section]

The correction processing section 20 executes, as an important function of the disclosure, correction processing on burn-in (luminance degradation) in addition to various kinds of signal processing by the signal processing section 21. A burn-in correction section 22 that performs this correction processing is configured of a gain correction section 23 for correction of luminance degradation and an offset correction section 24 for correction of gray-scale degradation. Herein, in a case where factors responsible for luminance degradation are divided into two, i.e., a luminance change (a high-luminance-side change) greatly influencing image quality degradation on a high luminance side and a luminance change (a low-luminance-side change) greatly influencing image quality degradation on a low luminance side, the gain correction section 23 performs correction of the high-luminance-side change, and the offset correction section 24 performs correction of the low-luminance side change.

The gain correction section 23 is configured of a luminance degradation prediction LUT 231, a degradation record integration section 232, and a luminance gain processing section 233. The luminance degradation prediction LUT 231 is a table (a look-up table) holding a predicted degradation value (an estimated value) that predicts luminance degradation by an image signal level. The offset correction section 24 is configured of a gray-scale degradation prediction LUT 241, a degradation record integration section 242, and a gray-scale offset processing section 243. The gray-scale degradation prediction LUT 241 is a table (a look-up table) holding a predicted degradation value that predicts gray-scale degradation by an image signal level.

The correction processing section 20 includes, in addition to the signal processing section 21 and the burn-in correction section 22 (the gain correction section 23 and the offset correction section 24), a dummy pixel pattern generation section 25 and a signal output section 26. The dummy pixel pattern generation section 25 generates a pattern signal for displaying of an aging pattern or a measurement pattern in each of measurement dummy pixel regions of the luminance degradation measurement dummy pixel group 16 and the gray-scale degradation measurement dummy pixel group 17. The signal output section 26 mixes an image signal having passed through the burn-in correction section 22 and a pattern signal supplied from the dummy pixel pattern generation section 25 or switches between them as appropriate.

(Concept of Burn-in Correction)

Hereinafter, a concept of burn-in correction executed in the correction processing section 20 will be described with reference to FIG. 2.

A luminance degradation amount ΔL is predicted according to the following expression (1), based on the luminance degradation prediction LUT 231 indicating luminance degradation per unit time by a lighting luminance condition and lighting time of the effective pixel of the organic EL panel 13.

$$\Delta L = \Sigma \Delta Ln \quad (1)$$

A degradation amount of gray-scale degradation (a voltage shift) is allowed to be calculated by the same method, based on the gray-scale degradation prediction LUT 241 indicating gray-scale degradation per unit time.

A burn-in gain and offset correction are performed on an input image signal, based on the thus-calculated predicted degradation value. More specifically, multiplication and addition/subtraction operation processing of a correction coefficient value are executed on an input image signal. The luminance degradation prediction LUT 231 is often formed, based on an average value of results measured under a specific luminance condition and a specific environment time with use of a plurality of panels for evaluation only or test cells before production introduction. Therefore, in a case where variation in panel characteristics is large, a sufficient correction effect may not be obtained.

The technology of the disclosure provides a method capable of obtaining a sufficient correction effect on correction accuracy for luminance degradation and gray-scale degradation even if variation in characteristics occur in an individual panel. The method will be described below.

Burn-in correction is allowed to be executed separately on a luminance degradation component and a gray-scale degradation component. The luminance degradation is caused by degradation of light emission efficiency of materials of the organic EL device as a main factor. The gray-scale degradation is caused by degradation (a decline) in characteristics (a light emission start voltage shift) of a transistor for driving of the organic EL device. Since these degradations eventually appear as luminance changes, it is possible to measure a luminance change of a light-emitting pixel. However, degradation in characteristics of the transistor is a luminance change on the low luminance side; therefore, effective correction is not allowed to be performed only by measurement of the luminance change.

In the technology of the disclosure, degradation of an actual pixel is measured by measuring luminance degradation and gray-scale degradation as a luminance change and a current change, respectively, and the degradation prediction LUTs 231 and 241 are automatically updated, based on thus-obtained measurement results as appropriate. Thus, variation in characteristics of each panel is allowed to be reduced. A section that modifies the degradation prediction LUTs 231 and 241 corresponds to the modification processing section 30 that will be described later.

[Configuration of Modification Processing Section]

The modification processing section 30 is configured of a luminance sensor 31, a current sensor 32, a dummy pixel sensor control section 33, a sensor signal processing section 34, an initial characteristic holding section 35, a luminance/gray-scale degradation calculation section 36, a degradation amount prediction LUT holding section 37, a dummy pixel degradation record integration section 38, and a degradation amount prediction LUT modification value calculation section 39.

The luminance sensor 31 is an example of a luminance detection section that detects a luminance change of a dummy pixel in the luminance degradation measurement dummy pixel group 16. The current sensor 32 is an example of a current detection section (a current detection circuit) that detects a current change of a dummy pixel in the gray-scale degradation measurement dummy pixel group 17.

The dummy pixel sensor control section 33 is configured to control operations of the luminance sensor 31 and the current sensor 32 and light emission of the dummy pixels. The sensor signal processing section 34 is configured to perform processing of averaging output signals of the luminance sensor 31 and the current sensor 32.

The initial characteristic holding section 35 is configured to hold an initial measurement result serving as a reference when a degradation amount is detected. The luminance/gray-scale degradation calculation section 36 is configured to calculate a degradation amount by measurement results of the luminance change and the current change after aging. As used herein, the term "aging" refers to allowing a dummy pixel to emit light with uniform luminance during a period of use by a user. The degradation amount prediction LUT holding section 37 is configured to predict each degradation amount from a light emission value of the dummy pixel. The dummy pixel degradation record integration section 38 is configured to integrate records of the degradation amount of the dummy pixel of which the degradation amount has been predicted. The degradation amount prediction LUT modification value calculation section 39 is configured to modify degradation prediction LUTs, based on a luminance/gray-scale degradation amount determined by a record integration result and a result of measurement on an actual pixel.

(Summary of Processing of Modifying Degradation Prediction LUT)

Description will be given of a summary of processing of modifying the luminance degradation prediction LUT and the gray-scale degradation prediction LUT by a dummy pixel for degradation measurement in the modification processing section 30 with the foregoing configuration.

Processing of modifying the degradation prediction LUT is executed by two steps, i.e., a step of initial processing and a step of normal processing that is performed in use by a user. The initial processing may be desirably executed before shipment of the display panel module 10. However, the initial processing is executed not only before the shipment but also after the display panel module 10 is formed into a product and at the time of initial setting before use by the user.

A procedure of the step of the initial processing will be described with reference to a flowchart in FIG. 3A. First, light emission voltage characteristics (V-L) and light emission current characteristics (I-L) before the start of aging as references for calculation of a degradation amount of a dummy pixel for degradation measurement, i.e., initial characteristics of the dummy pixel are measured as reference data by the luminance sensor 31 and the current sensor 32 (step S11). Next, the measured initial characteristics of the dummy pixel are stored in the initial characteristic holding section 35 through the sensor signal processing section 34 (step S12).

The normal processing performed in use by the user includes a normal operation mode and a measurement/LUT modification mode.

A procedure of the normal operation mode in the normal processing will be described with reference to a flowchart in FIG. 3B. First, aging is performed by allowing the dummy pixel for degradation measurement to emit light at predetermined luminance, and at the same time, a record of the degradation amount of the dummy pixel is calculated by the degradation prediction LUT according to a gray-scale of an aging pixel (step S21).

Next, whether or not a fixed period has elapsed is determined (step S22). As used herein, the fixed period (fixed time) may be set to one display frame period. Then, until it is determined that the fixed period has elapsed in the step S22, processing in the step S21, that is, lighting of the aging pixel and calculation of the record of the degradation amount are repeatedly executed. Therefore, records of the degradation amount are integrated in every fixed period, i.e., every display frame period. Then, a degradation record integration amount is regularly stored (step S23). Processing in this normal operation mode is processing by the dummy pixel degradation record integration section 38.

Next, a procedure of the measurement/LUT modification mode in the normal processing will be described with reference of a flowchart in FIG. 4. First, the light emission voltage characteristics and the light emission current characteristics of the dummy pixel for degradation measurement after being aged for a predetermined time t are measured (that is, degradation data is obtained) and stored (step S31). Next, a luminance degradation amount (a gain degradation amount) $\Delta Ld$ is calculated, based on the light emission voltage characteristics and the light emission current characteristics measured in the initial processing (that is, reference data) and the light emission voltage characteristics and the light emission current characteristics measured after aging (that is, degradation data) (step S32). The processing of calculating the luminance degradation amount $\Delta Ld$ is processing by the luminance/gray-scale degradation calculation section 36.

Next, the degradation record integration amount $\Delta Lm$ under each aging condition is read (step S33), and then a correction coefficient is calculated, based on the luminance degradation amount $\Delta Ld$ calculated from the foregoing measurement result and the degradation record integration value $\Delta Ld$ derived by integration in the normal operation mode (step S34). Then, the degradation prediction LUT is updated, based on the calculated correction coefficient, and is stored (step S35). The processing of updating and storing the degradation prediction LUT is performed by the degradation amount prediction LUT holding section 37 and the degradation amount prediction LUT modification value calculation section 39.

The processing of updating the degradation prediction LUT by the dummy pixels is completed by performing the above processing. After updating processing is completed, the mode is changed to the normal operation mode again, and aging restarts. From then on, the normal operation mode and the measurement/LUT modification mode are alternately repeated at regular intervals, and the degradation prediction LUT is updated as appropriate. Execution of the normal operation mode and the measurement/LUT modification mode is not limited to regular repeating (at set intervals) of the normal operation mode and the measurement/LUT modification mode, and the normal operation mode and the measurement/LUT modification mode may be executed in each driving mode.

Although the processing of modifying the luminance degradation prediction LUT is described above, the processing of modifying the gray-scale degradation prediction LUT is basically similar to the processing of modifying the luminance degradation prediction LUT.

(Detection Pattern, Sensor Measurement Method, and Degradation Amount Calculation Method)

A detection pattern for detection of each degradation amount, a measurement method using the detection pattern by the luminance sensor 31, and a degradation amount calculation method will be described below.

The display panel module (organic EL panel module) 10 includes the luminance degradation measurement dummy pixel group 16 for monitoring of luminance degradation and the gray-scale degradation measurement dummy pixel group 17 for monitoring of gray-scale degradation (current degradation).

First, the luminance degradation measurement dummy pixel group 16 will be described. The detection pattern for detection of the degradation amount is an arrangement pattern of light-emitting pixels and non-light-emitting pixels in the luminance degradation measurement dummy pixel group 16. As the detection pattern, a pattern in which the light-emitting pixels (lighting pixels) and non-light-emitting pixels (non-lighting pixels) are mixed is used. For example, a detection pattern with a checkered pattern configuration illustrated in FIG. 5A in which the light-emitting pixels and the non-light-emitting pixels are repeatedly provided in a checkered pattern or a detection pattern with a vertical-line (striped) pattern configuration illustrated in FIG. 5B in which the light-emitting pixels and the non-light-emitting pixels are repeatedly provided in a vertical-striped pattern may be used.

In an aging state, the light-emitting pixels are constantly lit under a predetermined luminance condition. The non-light-emitting pixels are not lit even during aging. A reason for mixing the light-emitting pixels and the non-light-emitting pixels as with the checkered pattern configuration illustrated in FIG. 5A or the vertical-line pattern configuration illustrated in FIG. 5B is that it is possible to detect, by the non-light-emitting pixels, a change without degradation caused by light emission.

An optimum pattern size is selected as the size of the detection pattern according to light reception sensitivity of the luminance sensor 31 or a pixel size. In FIG. 5A, the size in plan view of the luminance sensor 31 is indicated by a chain double-dashed line. As illustrated in FIG. 5A, the detection pattern is so provided as to have a size (region) larger than the size in plan view of the luminance sensor 31. The detection pattern is applied to all colors that perform aging. Moreover, in the detection pattern, patterns equal in number to luminance conditions of the degradation prediction LUT may be desirably provided at intervals at which an adjacent pattern does not influence measurement.

Hereinafter, a measurement method and a degradation amount calculation method by the luminance sensor 31 will be described using, as an example, a case where the detection pattern with the vertical-line pattern configuration illustrated in FIG. 5B is used.

In the detection pattern with the vertical-line pattern configuration, for example, dummy pixels in odd-numbered columns serve as lighting (aging) pixels and dummy pixels in even-numbered columns serve as non-lighting (non-aging) pixels. Then, at the time of measurement, the dummy pixel pattern generation section 25 makes a display pattern signal $V_{sig}$ variable in a predetermined display gray-scale range in both the lighting pixels and the non-lighting pixels, and a gray-scale-luminance relationship is measured by the luminance sensor 31.

Next, a temporal and environmental change amount Gain_ref/Offset_ref is calculated from a measurement result of gray-scale-luminance in initial measurement of the non-lighting pixel and a measurement result after the lapse of the predetermined time t of gray-scale-luminance of the non-lighting pixel. Next, a temporal and environmental change of the measurement value of the gray-scale-luminance of the lighting pixel after aging is corrected, based on the temporal and environmental change amount Gain_ref/Offset_ref. Then, each luminance/gray-scale degradation amount after lighting and aging is calculated from a correction result of the temporal and environmental change and a measurement result of gray-scale-luminance that has been initially measured as a degradation amount calculation reference value.

A specific calculation method will be described below. As illustrated in FIG. 6, gray-scales at all measurement points when luminance at the time of initial measurement (initial characteristics) and luminance after aging are equal to each other are determined to derive a relationship of gray-scale after aging (gray-scale after degradation)-initial gray-scale (gray-scale before degradation). In an expression illustrated in FIG. 6, light emission characteristics of the organic EL panel 13 may be, for example, $\gamma=2.2$, where y is luminance, x is a gray-scale, a ($a_1$, $a_2$, . . . ) is a luminance degradation coefficient, and b ($b_1$, $b_2$, . . . ) is a gray-scale degradation coefficient.

Then, a luminance degradation amount (a gain component) and a gray-scale degradation amount (an offset component) are allowed to be calculated with use of a regression operation by a method of least squares, based on a thus-derived result. More specifically, calculation is performed to determine a gray-scale in non-aging to which aging luminance at the same gray-scale as that at a measurement point (gray-scale) in non-aging corresponds (linear interpolation is performed between measurement points), thereby calculating the luminance degradation amount and the gray-scale degradation amount by regression computation.

A measurement gray-scale range and measurement steps when a gray-scale-luminance relationship is measured by the luminance sensor 31 are as described below. FIG. 7A illustrates V-L characteristics (voltage-luminance) at the time of initial measurement in luminance degradation measurement, and FIG. 7B illustrates V-L characteristics (voltage-current) at the time of normal measurement in luminance degradation measurement. At the time of initial measurement, since a result of the initial measurement serves as a reference, close measurement is performed by relatively fine steps. On the other hand, at the time of normal measurement, because of being used by a user, rough measurement is performed by relatively large steps. The measurement steps are basically equally set, but may be set unequally. The direction of the steps at the time of measurement is arbitrarily changeable. Since the direction of the steps is changeable, for example, measurement in both directions may be performed to take an average.

FIG. 8A illustrates V-L characteristics at the time of the initial measurement in the gray-scale degradation measurement, and FIG. 8B illustrates V-L characteristics at the time of normal measurement in the gray-scale degradation measurement. The concept of the measurement step is basically the same as that in the luminance degradation measurement. It is to be noted that a light emission start voltage shift is detected in the gray-scale degradation measurement; therefore, the measurement range may be limited to a range on a low gray-scale side.

As described above, the gray-scale degradation amount (the offset component) is allowed to be calculated from the measurement result of the luminance sensor 31; however, this embodiment is characterized in that the luminance sensor 31 is used only for correction of the luminance degradation amount (the gain component).

(Correction of Luminance Degradation Prediction LUT)

Next, a specific processing method of correction of the luminance degradation prediction LUT 231 will be described.

A correction coefficient is calculated, based on the luminance degradation amount (the gain component) calculated from the foregoing measurement result of the luminance change of the aging pixel, time in which lighting is performed at predetermined luminance at the time of normal operation, and a degradation record integration value calculated from the luminance degradation prediction LUT 231. In a case where integration of lighting time is performed by a CPU, the degradation record integration value is allowed to be calculated from the luminance degradation prediction LUT 231 and a time integration value by the following procedure.

Lighting integration time T is defined by the following expression (2).

$$T=T_m \tag{2}$$

Next, in luminance degradation curve characteristics illustrated in FIG. 9, time $\Delta t_i$ with respect to each change ratio $a_i$ is calculated, based on the following expression (3).

$$\Delta t_i=\Delta L/a_i \tag{3}$$

$T_d$ and i that satisfy the following expression (4) are calculated by the foregoing expressions (2) and (3).

$$T_d=T_m-\Sigma\Delta t_i<0 \tag{4}$$

Then, i satisfying the expression (4) is defined as i=n.

A record integration value $L_m$ is calculated by the following expression (5) from $T_d$ and n determined by the foregoing expression (4).

$$T_d=\Delta L\times n+a_{n+1}\times\Delta T_d \tag{5}$$

Thus, how much degradation occurs is calculated as the record integration value $L_m$ from the luminance degradation curve characteristics illustrated in FIG. 9.

As the correction coefficient, a LUT correction coefficient $C_{of}$ at each luminance is calculated by the following expression (6), based on a degradation amount record accumulation result ΔL_master of each dummy pixel and a degradation amount ΔL_dummy calculated from a sensor detection result of the dummy pixel.

[Math. 1]

$$C_{of}=\frac{\Delta L_dummy_t_n-\Delta L_dummy_t_{n-1}}{\Delta L_master_t_n-\Delta L_master_t_{n-1}} \tag{6}$$

Thus, the correction coefficient $C_{of}$ is calculated as a ratio between a difference of the luminance degradation amount from information of a previous luminance degradation amount (the gain component) and a difference of the degradation record integration value from the previous degradation integration value. The luminance degradation prediction LUT 231 that is to be updated is generated by multiplying a directly previous degradation prediction LUT by the correction coefficient $C_{of}$. When the above processing is repeated appropriately, the luminance degradation prediction LUT 231 previously set in the organic EL display unit 1 is updated. The degradation record of the effective pixel is modified with use of an average value of the correction coefficient $C_{of}$.

(Pixel Circuit of Effective Pixel)

A specific circuit configuration of the effective pixel configuring the effective pixel region 15 of the organic EL panel 13 will be described with reference to FIG. 10. FIG. 10 is a circuit diagram illustrating an example of a specific circuit configuration of the effective pixel. A light emission section of the effective pixel 50 is configured of an organic EL device 51 that is a current-driven light-emitting device (an electro-optic device) of which light emission luminance varies according to a current value passing through a device.

As illustrated in FIG. 10, the effective pixel 50 is configured of the organic EL device 51 and a driving circuit that drives the organic EL device 51 by supplying a current to the organic EL device 51. A cathode electrode of the organic EL device 51 is connected to a common power supply line 64 wired to all pixels 50.

The driving circuit that drives the organic EL device 51 is configured of a driving transistor 52, a sampling transistor (writing transistor) 53, a retention capacitor 54, and an auxiliary capacitor 55. In other words, the driving circuit exemplified here has a 2Tr/2C circuit configuration configured of two transistors (22 and 23) and two capacitors (24 and 25).

As the driving transistor 52 and the sampling transistor 53, for example, N-channel TFTs may be used. However, a conductive type combination of the driving transistor 52 and the sampling transistor 53 that is described here is merely an example, and the combination is not limited thereto. In other words, a P-channel TFT may be used as one or both of the driving transistor 52 and the sampling transistor 53.

In the driving circuit with the foregoing circuit configuration, as will be described later, light emission/non-light emission (light emission time) of the organic EL device 51 is controlled by switching a power supply voltage applied to the driving transistor 52. Therefore, in the organic EL panel 13 having this pixel circuit, as a vertical drive section (a scan driver) that drives the effective pixel 50, in addition to a gate scan driver 12, a power supply scan driver 18 is provided.

Moreover, in the effective pixel region 15, with respect to an arrangement of the effective pixels 50 in a matrix, a scanning line 61 and a power supply line 62 are wired to each pixel row along a row direction (an arrangement direction of pixels in a pixel row/a horizontal direction). Moreover, a signal line is wired to each pixel column along a column direction (an arrangement direction of pixels in a pixel column/a vertical direction). The scanning line 61 is connected to an output terminal of a row corresponding to the gate scan driver 12. The power supply line 62 is connected to an output terminal of a row corresponding to the power supply scan driver 18. The signal line 63 is connected to an output terminal of a column corresponding to the data driver 11.

The data driver 11 selectively outputs a signal voltage $V_{sig}$ of an image signal according luminance information supplied from a signal supply source (not illustrated) and a reference voltage $V_{ofs}$. Herein, the reference voltage $V_{ofs}$ is a voltage (for example, a voltage corresponding to a black level of the image signal) serving as a reference of the signal voltage $V_{sig}$ of the image signal, and is used for correction processing on a known threshold voltage ($V_{th}$) or the like.

In writing of the signal voltage of the image signal to the effective pixels 50, the gate scan driver 12 performs so-called line-sequential scanning in which the pixels 50 in the effective pixel region 15 are scanned from row to row by sequentially supplying a writing scanning signal WS to the scanning lines 61.

The power supply scan driver 18 supplies, to the power supply line 62, a power supply voltage DS that allows for switching between a first power supply voltage $V_{cc_H}$ and a second power supply voltage $V_{cc_L}$ that is lower than the first power supply voltage $V_{cc_H}$ in synchronization with linear-sequential scanning by the gate scan driver 12. By switching between $V_{cc_H}/V_{cc_L}$ of the power supply voltage DS by the power supply scan driver 18, control of light emission/non-light emission (light extinction) of the effective pixel 50 is performed.

One electrode of electrodes (source/drain electrodes) of the driving transistor 52 is connected to an anode electrode of the organic EL device 51, and the other electrode of the electrodes (the source/drain electrodes) of the driving transistor 52 is connected to the power supply line 62. One electrode of electrodes (source/drain electrodes) of the sampling transistor 53 is connected to the signal line 63, and the other electrode of the electrodes (the source/drain electrodes) of the sampling transistor 53 is connected to a gate electrode of the driving transistor 52. Moreover, a gate electrode of the sampling transistor 53 is connected to the scanning line 61.

In the driving transistor 52 and the sampling transistor 53, the one electrode refers to a metal wiring line electrically connected to one source/drain region, and the other electrode refers to a metal wiring line electrically connected to the other source-drain region. Moreover, depending on a potential relationship between the one electrode and the other electrode, the one electrode may be a source electrode or a drain electrode, and the other electrode may be a drain electrode or a source electrode.

One electrode of the retention capacitor 54 is connected to the gate electrode of the driving transistor 52, and the other electrode of the retention capacitor 54 is connected to the other electrode of the driving transistor 52 and the anode electrode of the organic EL device 51. One electrode of the auxiliary capacitor 55 is connected to the anode electrode of the organic EL device 51, and the other electrode of the auxiliary capacitor 55 is connected to a node (the common power supply line 64/a cathode electrode of the organic EL device 51 in this example) with a fixed potential. The auxiliary capacitor 55 is provided to compensate for a shortage of capacity of the organic EL device 51, thereby enhancing a writing gain of an image signal with respect to the retention capacitor 54. However, the auxiliary capacitor 55 is not essential component. In other words, in a case where it is not necessary to compensate for the shortage of the capacity of the organic EL device 51, the auxiliary capacitor 55 is not necessary.

In the effective pixel 50 with the foregoing configuration, the sampling transistor 53 is turned to a conduction state in response to a High-active writing scanning signal WS applied from the gate scan driver 12 to the gate electrode through the scanning line 61. Therefore, the sampling transistor 53 samples one of the signal voltage $V_{sig}$ of the image signal according to the luminance information and the reference voltage $V_{ofs}$ that are supplied from the data driver 11 through the signal line 63 at different timings, and writes the voltage $V_{sig}$ or $V_{ofs}$ in the pixel 50. The signal voltage $V_{sig}$ or the reference voltage $V_{ofs}$ written by the sampling transistor 53 is applied to the gate electrode of the driving transistor 52, and is held by the retention capacitor 54.

When the power supply voltage DS of the power supply line 62 is at the first power supply voltage $V_{cc_H}$, one electrode and the other electrode of the driving transistor 52 serve as a drain electrode and a source electrode, respectively, to allow the driving transistor 52 to operate in a saturation region. Therefore, the driving transistor 52 drives the organic EL device 51 in response to reception of supply of a current from the power supply line 62 to emit light by a current drive. More specifically, when the driving transistor 52 operates in the saturation region, the driving transistor 52 supplies, to the organic EL device 51, a drive current with a current value corresponding to the voltage value of the signal voltage $V_{sig}$ stored in the retention capacitor 54 to current-drive the organic EL device 51, thereby allowing the organic EL device 51 to emit light.

When the power supply voltage DS is switched from the first power supply voltage $V_{cc_H}$ to the second power supply voltage $V_{cc_L}$, one electrode and the other electrode of the driving transistor 52 serve as the source electrode and the drain electrode, respectively, to allow the driving transistor 52 to operate as a switching transistor. Thus, the driving transistor 52 stops supply of the drive current to the organic EL device 51 to turn the organic EL device 51 to a non-light emission state. In other words, the driving transistor 52 also have a function as a transistor controlling light emission time (light emission/non-light emission) of the organic EL device 51 by switching of the power supply voltage DS ($V_{cc_H}$/$V_{cc_L}$).

The above-described organic EL panel 13 has a so-called one-side drive configuration in which each of the gate scan driver 12 and the power supply scan driver 18 is provided on one of the right and the left of the effective pixel region 15; however, the configuration is not limited thereto. In other words, a so-called both-side drive configuration in which the gate scan driver 12 and the power supply scan driver 18 are provided on both the right and the left of the effective pixel region 15 may be adopted. When this both-side drive configuration is adopted, an issue of propagation delay caused by wiring resistance and wiring capacity (parasitic capacity) of the scanning line 61 and the power supply line 62 is allowed to be eliminated.

(Principle of Detection of Light Emission Current Change and Configuration of Current Sensor)

Next, a principle of detecting a change in a light emission current $I_{ds}$ of the dummy pixel for gray-scale degradation measurement and a configuration of the current sensor (a current detection section/current detection circuit) 32 will be described below.

One or more scan lines (one or more rows) of the dummy pixels for gray-scale degradation measurement (pixels for current change detection only) are provided outside the effective pixel region 15. As illustrated in FIG. 11, a change in the light emission current $I_{ds}$ is detected by a voltage value generated at both terminals of the detection resistor 71 inserted between an output terminal of the gate scan driver 12 (12A and 12B) for the scan line and the power supply line 62 as a wiring line for panel light emission power supply. A specific configuration of the current sensor 32 for detection of the light emission current $I_{ds}$ will be described later.

It is to be noted that in the above-described pixel configuration, in a case where the light emission time of the organic EL device 51 is controlled by switching of the power supply voltage DS, or the like, the light emission current $I_{ds}$ passing through the organic EL device 51 serves as a pulsed response. In such a case, in synchronization with light emission current as the pulsed response, more specifically in synchronization with control of the light emission time, a current change in the light emission current $I_{ds}$ in an effective light emission period is detected.

Incidentally, in a display unit for color display, one pixel (a unit pixel) as a unit forming a color image is configured of a plurality of pixels (sub-pixels). The one pixel may be configured of, for example, three sub-pixels, i.e., a sub-pixel emitting red (R) light, a sub-pixel emitting green (G) light, and a sub-pixel emitting blue (B) light. At this time, as a pixel that is to be subjected to detection of a current change, aging and degradation detection may be performed on pixels of all colors or a pixel of a specific color (a representative color).

FIG. 11 illustrates pixel circuits of two dummy pixels 17A in a first line (row) of the gray-scale degradation measurement dummy pixel group 17. As can be seen from a comparison between FIG. 10 and FIG. 11, the dummy pixel 17A has a configuration similar to that of the effective pixel 50. In other words, the dummy pixel 17A is configured of the organic EL device 51, the driving transistor 52, the sampling transistor 53, the retention capacitor 54, and the auxiliary capacitor 55. The dummy pixel 17A also has the same operation conditions such as a driving voltage and driving timing as the effective pixel 50. The same applies to dummy pixels in the luminance degradation measurement dummy pixel group 16.

FIG. 12 is a wiring diagram illustrating an example of wiring lead-out of the power supply line 62 for current detection of the dummy pixel for gray-scale degradation measurement. In FIG. 12, for ease of understanding, the scanning line 61 is indicated by a broken line, and the power supply line 62 is indicated by an alternate long and short dashed line. In this example, the power supply lines 62 of gates No. 1 to 4 are wiring lines for current detection of the dummy pixel, and current detection is performed with use of the wiring lines of the gates No. 1 and No. 3.

As illustrated in FIG. 12, the power supply line 62 connected to the detection resistor 71 reaches a relay substrate 43 (or a relay substrate 44) through a data COF (Chip On Film) 41 provided with the data driver 11 (or a gate COF 42 provided with the gate scan driver 12). Then, the power supply line 62 reaching the relay substrate 43 (or the relay substrate 44) is connected to the detection resistor 71 disposed in the relay substrate 43 (or the relay substrate 44).

It is to be noted the gray-scale degradation measurement dummy pixel group (region) 17 for current change detection is covered with a light-shielding configuration such as a black mask so as to prevent leakage of light emitted from the dummy pixels 17A to outside.

In FIG. 11, the current sensor 32 includes, in addition to the detection resistor 71 for detection of the light emission current $I_{ds}$, a difference amplifier circuit 72 that amplifies a feeble detection voltage and an AD converter 73 that converts an analog voltage to a digital value, and is provided in the relay substrate 43 (or the relay substrate 44). The difference amplifier circuit 72 is an example of a detection amplifier that detects a feeble detection voltage generated between both terminals of the detection resistor 71. The digital value of the detection voltage for the light emission current $I_{ds}$ outputted from the AD converter 73 is supplied to the sensor control section (dummy pixel sensor control section) 33. The sensor control section 33 performs various kinds of settings for the current sensor 32, conversion triggering, and reading of a measurement value.

The current sensor 32 further includes a switch 74 configured to bypass (short-circuit) the detection resistor 71 at the time of normal operation and a switch 75 configured to switch to a one-side driving (one-side power supply) only at the time of detection in a case of both-side driving (both-side power supply). These switches 74 and 75 are provided as one contrivance to reduce an influence of a voltage drop by the detection resistor 71 at the time of aging and to effectively detect a feeble current at the time of measurement.

The detection current in one line is feeble. Under such a circumstance, the gate scan drivers 12A and 12B including the power supply scan driver 18 are present on both the right and the left with the effective pixel region 15 in between, and when the power supply voltage DS is supplied from both sides of the panel, a flow of the current may be dispersed, and accordingly measurement may not be performed equally, thereby causing a decline in detection accuracy. The switch 75 is provided as measures against this, that is, not to disperse the flow of current and to achieve an improvement in detection accuracy.

An operation example of the switches 74 and 75 is illustrated in FIG. 13. Description will be given of a case where the dummy pixel 17A for gray-scale degradation measurement as a pixel for current change detection only include four modes, i.e., a mode 1 at the time of an aging mode-startup, a mode 2 at the time of one-side driving aging, a mode 3 at the time of measurement of a current $I_{ds}/2$, and a mode 4 as a current measurement mode.

In the mode 1 at the time of the aging mode-startup, both the switch 74 closer to the detection resistor 71 and the switch 75 closer to a separation gate are in a close state. In the mode 2 at the time of the one-side driving aging, the switch 74 is in the close state, and the switch 75 is in an open state. In the mode 3 at the time of measurement of the current $I_{ds}/2$, the switch 74 is in the open state, and the switch 75 is in the close state. In the mode 4 at the current measurement mode, both the switches 74 and 75 are in the open state.

(Detection Pattern for Current Change Detection)

An example of a detection pattern for detection of a current change that is applied to the dummy pixel for gray-scale degradation measurement is illustrated in FIG. 14. In the detection pattern, one line (one row) is divided into a plurality of pixel blocks, and is configured of one or more kinds of aging pixel regions (always-lighting pixel blocks) with different luminance conditions and a non-aging pixel section (a non-lighting pixel block). A black pattern (the non-aging pixel section) is inserted in each line to correct variation in the current sensor 32 and degradation with time. At the time of measurement, variation in the current sensor 32 and degradation with time are allowed to be corrected by measuring characteristics at 0 [nit] and comparing the characteristics to an initial value.

Moreover, a detection pattern designed to reduce variation in characteristics caused by a panel position at the time of aging and at the time of measurement may be adopted. More specifically, as illustrated in FIG. 15, a plurality of blocks configured of a combination of always-lighting pixels (aging pixels) with one or more kinds of luminance conditions and a non-lighting pixel (a non-aging pixel) in the detection pattern may be periodically provided in one line. As with the dummy pixel for luminance degradation measurement, in the aging state, the light-emitting pixels are constantly lit under a predetermined luminance condition. The non-light-emitting pixels are not lit even during aging.

At the time of measurement (the initial operation and the normal operation), the display pattern signal $V_{sig}$ (display gray-scale) is variable in a predetermined display gray-scale range in both the light-emitting pixels and the non-light-emitting pixels, and a relationship between a display gray-scale and a light emission current is measured as a voltage value generated between both terminals of the detection resistor 71. With regard to light emission current degradation, it is important to detect a light emission start voltage; therefore, detection with high accuracy is achievable by a detection circuit configuration and sampling with emphasis specifically on an improvement in measurement sensitivity on a low-luminance side.

With regard to subsequent processing of updating the gray-scale degradation prediction LUT, the same processing as the processing of updating the luminance degradation prediction LUT by the dummy pixel for the luminance degradation measurement and the luminance sensor 31 is executed. However, updating of the gray-scale degradation prediction LUT is characterized in that only a calculated offset component (gray-scale degradation) is used for correction.

Even if variation in characteristics of an individual panel occurs, an effect of correcting luminance degradation and gray-scale degradation with sufficient correction accuracy is allowed to be obtained by executing all of the above-described processing. In particular, even if an expensive luminance sensor with high sensitivity or the like is not used, variation in a predicted degradation value (an estimated value) of a light emission start voltage shift greatly influencing image quality degradation on the low-luminance side is allowed to be accurately corrected. In the luminance sensor 31, the measurement time is allowed to be reduced by giving a high priority to measurement on the high-luminance side. Moreover, since it is possible to reduce degradation in sensitivity of the luminance sensor 31 and an influence of a measurement error due to a shift of a mounting position with time, correction accuracy is improved.

Modification Examples

Although the technology of the disclosure has been described using the embodiments, the technology of the disclosure is not limited to the scope of the foregoing embodiments. Namely, various changes and modifications may be made to the foregoing embodiments without departing from the spirit of the technology of the disclosure, and the changed or modified configurations are also included in the technical scope of the technology of the disclosure.

For example, in the foregoing embodiments, a configuration in which the luminance degradation measurement dummy pixel group 16 and the gray-scale degradation measurement dummy pixel group 17 are separately provided is adopted; however, a configuration in which a common dummy pixel group is shared between them (common pixels are used) may be adopted. Since a region provided with dummy pixels for measurement is allowed to be reduced by using a common dummy pixel group serving as both the luminance degradation measurement dummy pixel group 16 and the gray-scale degradation measurement dummy pixel group 17, it is possible to minimize an increase of a frame of the organic EL panel 13 by providing the dummy pixels for measurement.

Moreover, in the foregoing embodiments, a case where each of the dummy pixels in the luminance degradation measurement dummy pixel group 16 and the gray-scale degradation measurement dummy pixel group 17 uses a pixel configuration similar to that of the effective pixel 50 is described as an example; however, the dummy pixels are not limited thereto. The gray-scale degradation occurs when the light emission current $I_{ds}$ is changed by degradation (a decline) in the transistor characteristics (a light emission start voltage shift) of the driving transistor 52. Therefore, in a case where attention is focused on a change in the light emission current $I_{ds}$, even if a change in a current passing only through the driving transistor 52 is detected, it is possible to measure the gray-scale degradation.

As illustrated in FIG. 16, the dummy pixel 17B in the gray-scale degradation measurement dummy pixel group 17 has the same configuration (for example, a TFT configuration) as that of the pixel circuit of the effective pixel 50, and has a pixel configuration to which the organic EL device 51 is not connected (a pixel configuration without the organic EL device 51). More specifically, gray-scale degradation is measured by directly connecting one electrode of electrodes (source/drain electrodes) of the driving transistor 52 to the common power supply line 64 and detecting a change in a current passing through the driving transistor 52.

As with the foregoing embodiments, in a case where the dummy pixel 17A allowing the organic EL device 51 to emit light is used for measurement, a contrivance for not exerting, on the effective pixel region 15, an influence by light emission is necessary. More specifically, it may be necessary to dispose the gray-scale degradation measurement dummy pixel group 17 at some distance from the effective pixel region 15, or as described above, a light-shielding configuration may be necessary. On the other hand, in a pixel configuration without the organic EL device 51 as with the circuit configuration of a dummy pixel 17B according to this modification example, a restriction that the dummy pixel 17B is disposed outside the effective pixel region 15 is eliminated, and the light-shielding configuration is not necessary; therefore, flexibility of panel design is further improved. For example, compared to the pixel configuration having the organic EL device 51, it is possible to narrow the frame of the panel; therefore, it is possible to increase a screen size.

Moreover, in the foregoing embodiments, the detection resistor 71, the difference amplifier circuit 72, and the like configuring the current detection section (current sensor) 32 are provided in the relay substrate 43 (or the relay substrate 44); however, they may be provided on the organic EL panel 13, or may be contained in the data driver 11 or the gate scan driver 12. Even in this case, a detection voltage propagates to the relay substrate 44 (or the relay substrate 45) through the data COF 41 (or the gate COF 42).

Further, in the foregoing embodiments, the driving circuit that drives the organic EL device 51 is a 2Tr/2C circuit configured of two transistors (52 and 53) and two capacitors (54 and 55); however, the driving circuit is not limited thereto. For example, a circuit configuration further including a switching transistor that selectively supplies the reference voltage $F_{ofs}$ to the driving transistor 52, or a circuit configuration further including one or more transistors as necessary may be adopted.

Furthermore, in the foregoing embodiments, a case where the disclosure is applied to the organic EL display unit using the organic EL device as the light-emitting device of the effective pixel 50 is described as an example; however, the disclosure is not limited to this application example. More specifically, the disclosure is applicable to all display units using a current-driven light-emitting device, such as an inorganic EL device, an LED device, and a laser diode device, of which light emission luminance varies according to a current value passing through a device.

It is to be noted that the disclosure may have the following configurations.

[1] An image signal processing circuit including: a display panel including a first dummy pixel provided outside an effective pixel region; a current detection section configured to detect a change in a current in the first dummy pixel; a modification processing section configured to modify a predetermined predicted degradation value, based on an actual degradation amount of the current detected by the current detection section; and a correction processing section configured to correct an image signal, based on the predicted degradation value modified by the modification processing section, the image signal being adapted to drive an effective pixel.

[2] The image signal processing circuit according to [1], in which the current detected by the current detection section is a current passing through a transistor, the transistor being configured to drive a light emission section of the first dummy pixel.

[3] The image signal processing circuit according to [1] or [2], further including a luminance detection section, in which the display panel includes a second dummy pixel provided outside the effective pixel region, the luminance detection section is configured to detect a change in a luminance in the second dummy pixel, and the modification processing section modifies the predetermined predicted degradation value, based on the actual degradation amount of the current detected by the current detection section and an actual degradation amount of the luminance detected by the luminance detection section.

[4] The image signal processing circuit according to any one of [1] to [3], in which the first dummy pixel and the second dummy pixel have a configuration similar to that of the effective pixel, and have the same operation condition as that of the effective pixel.

[5] The image signal processing circuit according to any one of [1] to [4], in which one or more rows of the first dummy pixels and one or more rows of the second dummy pixels are provided outside the effective pixel region.

[6] The image signal processing circuit according to any one of [1] to [5], in which a common pixel is shared by the first dummy pixel and the second dummy pixel.

[7] The image signal processing circuit according to any one of [1] to [6], in which the first dummy pixel and the second dummy pixel have a light-shielding configuration.

[8] The image signal processing circuit according to any one of [1] to [7], in which the current detection section includes a detection resistor connected between an output terminal of a driver and a power supply line, the driver being configured to drive the first dummy pixel, the power supply line being configured to supply a power supply voltage to the first dummy pixel, and a detection amplifier configured to detect a voltage value generated between both terminals of the detection resistor.

[9] The image signal processing circuit according to [8], in which the display panel has a configuration in which a power supply voltage is supplied from both sides horizontally, and the current detection section includes a switch configured to block supply of the power supply voltage from one side of the display panel at the time of detection of the change in the current.

[10] The image signal processing circuit according to [8] or [9], in which the current detection section includes a switch configured to selectively short both terminals of the detection resistor.

[11] The image signal processing circuit according to any one of [1] to [10], in which, when a light emission current of the first dummy pixel serves as a pulsed response, the current detection section detects the change in the current in synchronization with the light emission current as the pulsed response.

[12] The image signal processing circuit according to any one of [1] to [11], in which one line in a detection pattern for detection of the change in the current is divided into a plurality of pixel blocks, and is configured of one or more kinds of always-lighting pixel blocks with different luminance conditions and a non-aging pixel block.

[13] The image signal processing circuit according to any one of [1] to [12], in which a detection pattern for detection of the change in the current is configured of a combination of always-lighting pixels with one or more kinds of luminance conditions and a non-lighting pixel, and a plurality of blocks of the detection pattern are periodically provided in one line.

[14] The image signal processing circuit according to any one of [1] to [13], in which the first dummy pixel has a configuration without a light emission section.

[15] The image signal processing circuit according to any one of [1] to [14], in which a light emission section of each of an effective pixel and the dummy pixel is configured of a current-driven light-emitting device of which light emission is controlled according to intensity of a current.

[16] The image signal processing circuit according to [15], in which the current-driven light-emitting device is an organic electroluminescence device.

[17] An image signal processing method including: detecting a change in a current of a first dummy pixel provided outside an effective pixel region of a display panel; modifying a predetermined predicted degradation value, based on an actual degradation amount of the detected current; and correcting an image signal, based on the modified predicted degradation value, the image signal being adapted to drive an effective pixel.

[18] The image signal processing method according to [17], further including detecting a change in a current of a second dummy pixel provided outside the effective pixel region of the display panel, wherein the predetermined predicted degradation value is modified, based on the actual degradation amount of the detected current and an actual degradation value of a detected luminance.

[19] A display unit provided with an image signal processing circuit, the image signal processing circuit including: a display panel including a first dummy pixel provided outside an effective pixel region; a current detection section configured to detect a change in a current in the first dummy pixel; a modification processing section configured to modify a predetermined predicted degradation value, based on an actual degradation amount of the current detected by the current detection section; and a correction processing section configured to correct an image signal, based on the predicted degradation value modified by the modification processing section, the image signal being adapted to drive an effective pixel.

[20] The display unit according to [19], further including a luminance detection section, in which the display panel includes a second dummy pixel provided outside the effective pixel region, the luminance detection section is configured to detect a change in a luminance in the second dummy pixel, and the modification processing section modifies the predetermined predicted degradation value, based on the actual degradation amount of the current detected by the current detection section and an actual degradation amount of the luminance detected by the luminance detection section.

REFERENCE SIGNS LIST

1 . . . organic EL display unit, 10 . . . display panel module (organic EL panel module), 11 . . . data driver, 12 (12A, 12B) . . . gate scan driver, 13 . . . organic EL panel, 14 . . . timing controller, 15 . . . effective pixel region, 16 . . . luminance degradation measurement dummy pixel group, 17 . . . gray-scale degradation measurement dummy pixel group, 17A, 17B . . . dummy pixel, 18 . . . power supply scan driver, 20 . . . correction processing section, 21 . . . signal processing section, 22 . . . burn-in correction section, 23 . . . gain correction section, 24 . . . offset correction section, 25 . . . dummy pixel pattern generation section,

26 . . . signal output section, 30 . . . modification processing section, 31 . . . luminance sensor, 32 . . . current sensor, 33 . . . dummy pixel sensor control section, 34 . . . sensor signal processing section, 35 . . . initial characteristic holding section, 36 . . . luminance/gray-scale degradation calculation section, 37 . . . degradation amount prediction LUT holding section, 38 . . . dummy pixel degradation record integration section, 39 . . . degradation amount prediction LUT modification value calculation section, 41 . . . data COF, 42 . . . gate COF, 43, 44 . . . relay substrate, 50 . . . effective pixel, 51 . . . organic EL device, 52 . . . driving transistor, 53 . . . sampling transistor, 54 . . . retention capacitor, 55 . . . auxiliary capacitor, 61 . . . scanning line, 62 . . . power supply line, 63 . . . signal line, 64 . . . common power supply line, 71 . . . detection resistor, 72 . . . difference amplifier circuit, 73 . . . AD converter, 74, 75 . . . switch

The invention claimed is:

1. An image signal processing circuit comprising:

a display panel including a first dummy pixel provided outside an effective pixel region;

a current detection section configured to detect a change in a current in the first dummy pixel;

a modification processing section configured to modify a predetermined predicted degradation value, which indicates a predicted degradation per unit time, based on an actual degradation amount of the current detected by the current detection section; and a correction processing section configured to correct an image signal, based on the predicted degradation value modified by the modification processing section, the image signal being adapted to drive an effective pixel, wherein the current detection section includes a detection resistor connected between an output terminal of a driver and a power supply line, the driver being configured to drive the first dummy pixel, the power supply line being configured to supply a power supply voltage to the first dummy pixel, and a detection amplifier configured to detect a voltage value generated between both terminals of the detection resistor.

2. The image signal processing circuit according to claim 1, wherein the display panel has a configuration in which a power supply voltage is supplied from both sides horizontally, and the current detection section includes a switch configured to block supply of the power supply voltage from one side of the display panel at the time of detection of the change in the current.

3. The image signal processing circuit according to claim 1, wherein the current detection section includes a switch configured to selectively short both terminals of the detection resistor.

4. The image signal processing circuit according to claim 1, wherein a detection pattern for detection of the change in the current is configured of a combination of always-lighting pixels operating under one or more luminance conditions, and a non-lighting pixel, and a plurality of blocks of the detection pattern are periodically provided in one line.

5. An image signal processing circuit comprising:

a display panel including a first dummy pixel provided outside an effective pixel region;

a current detection section configured to detect a change in a current in the first dummy pixel;

a modification processing section configured to modify a predetermined predicted degradation value, which indicates a predicted degradation per unit time, based on an actual degradation amount of the current detected by the current detection section; and a correction processing section configured to correct an image signal, based on the predicted degradation value modified by the modification processing section, the image signal being adapted to drive an effective pixel, wherein, when a light emission current of the first dummy pixel serves as a pulsed response, the current detection section detects the change in the current in synchronization with the light emission current as the pulsed response.

6. The image signal processing circuit according to claim 5, wherein a detection pattern for detection of the change in the current is configured of a combination of always-lighting pixels operating under one or more luminance conditions, and a non-lighting pixel, and a plurality of blocks of the detection pattern are periodically provided in one line.

7. An image signal processing circuit comprising:

a display panel including a first dummy pixel provided outside an effective pixel region;

a current detection section configured to detect a change in a current in the first dummy pixel;

a modification processing section configured to modify a predetermined predicted degradation value, based on an actual degradation amount of the current detected by the current detection section; and a correction processing section configured to correct an image signal, based on the predicted degradation value modified by the modification processing section, the image signal being adapted to drive an effective pixel, wherein one line in a detection pattern for detection of the change in the current is divided into a plurality of pixel blocks, and is configured of one or more always-lighting pixel blocks, respective ones of the always-lighting pixel blocks operating under different luminance conditions, and a non-aging pixel block.

8. The image signal processing circuit according to claim 7, wherein a detection pattern for detection of the change in the current is configured of a combination of always-lighting pixels operating under one or more luminance conditions, and a non-lighting pixel, and a plurality of blocks of the detection pattern are periodically provided in one line.

* * * * *